US010962035B2

(12) United States Patent
Bakewell et al.

(10) Patent No.: US 10,962,035 B2
(45) Date of Patent: Mar. 30, 2021

(54) CYLINDRICAL ELEMENT PROFILED TO REDUCE VORTEX INDUCED VIBRATION (VIV) AND/OR DRAG

(71) Applicant: Balmoral Comtec Limited, Aberdeen (GB)

(72) Inventors: Brian John Bakewell, Montrose Angus (GB); Fraser James Milne, Brechin Angus (GB); Aneel Gill, Monifieth Angus (GB)

(73) Assignee: Balmoral Comtec Limited, Aberdeen (GB)

( * ) Notice: Subject to any disclaimer, the term of this patent is extended or adjusted under 35 U.S.C. 154(b) by 0 days.

(21) Appl. No.: 16/648,941

(22) PCT Filed: Oct. 19, 2018

(86) PCT No.: PCT/GB2018/053038

§ 371 (c)(1),
(2) Date: Mar. 19, 2020

(87) PCT Pub. No.: WO2019/077370

PCT Pub. Date: Apr. 25, 2019

(65) Prior Publication Data

US 2020/0248731 A1 Aug. 6, 2020

(30) Foreign Application Priority Data

Oct. 20, 2017 (GB) ..... 1717308
Jul. 19, 2018 (GB) ..... 1811787

(51) Int. Cl.
*B63B 1/36* (2006.01)
*E21B 17/01* (2006.01)
(Continued)

(52) U.S. Cl.
CPC ..... *F15D 1/12* (2013.01); *B63B 1/36* (2013.01); *B63B 39/005* (2013.01); *E21B 17/012* (2013.01); *B63B 2021/504* (2013.01)

(58) Field of Classification Search
CPC .. F15D 1/12; B63B 1/36; B63B 9/005; B63B 2021/504; E21B 17/012
See application file for complete search history.

(56) References Cited

U.S. PATENT DOCUMENTS 6,010,278 A * 1/2000 Denison ..... B63B 21/502 405/216
6,048,136 A * 4/2000 Denison ..... B63B 21/502 114/243
(Continued)

FOREIGN PATENT DOCUMENTS

WO 00/75546 12/2000
WO 02/072995 9/2002
(Continued)

OTHER PUBLICATIONS

GB1817104.1 Combined Search and Examination Report dated Apr. 12, 2019 (3 pages).
(Continued)

*Primary Examiner* — Benjamin F Fiorello
(74) *Attorney, Agent, or Firm* — SmithAmundsen LLC

(57) ABSTRACT

A generally cylindrical element 10 that is adapted for immersion in water is described. The generally cylindrical element 10 has an outer surface 11 that is in contact with the water in use. The outer surface 11 has at least two rows of repeating shapes 20, for example hexagons 20, provided on the surface 11, where each row of repeating shapes 20 is separated from the other or the adjacent row(s) by a groove arrangement 30. Each shape 20 within a row is separated from the, or each, adjacent shape 20 by at least one groove 30. This configuration of the surface 11 reduces Vortex
(Continued)

Induced Vibration (VIV) and/or drag that may act upon the generally cylindrical element 10 when it is immersed in a body of water.

29 Claims, 15 Drawing Sheets

(51) Int. Cl.

| | |
|---|---|
| ***F15D 1/12*** | (2006.01) |
| ***B63B 39/00*** | (2006.01) |
| *B63B 21/50* | (2006.01) |

(56) References Cited

U.S. PATENT DOCUMENTS

| | | | | |
|---|---|---|---|---|
| 7,628,665 | B1 * | 12/2009 | Cook | E21B 17/012 405/195.1 |
| 8,443,896 | B2 | 5/2013 | Howard et al. | |
| 9,022,827 | B2 * | 5/2015 | Snyder, II | F16L 1/24 441/133 |
| 10,323,665 | B2 * | 6/2019 | Potts | H01H 35/247 |
| 2004/0013473 | A1 * | 1/2004 | Gibson | E21B 17/012 405/211 |
| 2004/0051004 | A1 * | 3/2004 | Bearman | F15D 1/12 244/130 |
| 2008/0131210 | A1 * | 6/2008 | Wajnikonis | B63B 21/502 405/211 |
| 2008/0236469 | A1 * | 10/2008 | Masters | F16L 1/123 114/243 |
| 2008/0289829 | A1 * | 11/2008 | Bergeron | E21B 17/012 166/350 |
| 2010/0180972 | A1 * | 7/2010 | Yoon | F16L 9/006 138/39 |
| 2010/0284750 | A1 * | 11/2010 | Begley | E21B 17/012 405/224.2 |
| 2010/0307762 | A1 * | 12/2010 | Howard | E21B 17/012 166/350 |
| 2018/0016852 | A1 * | 1/2018 | von Eberstein | E21B 33/14 |

FOREIGN PATENT DOCUMENTS

| | | |
|---|---|---|
| WO | 02/095278 | 11/2002 |
| WO | 2010/141843 | 12/2010 |
| WO | 2016/205900 | 12/2016 |

OTHER PUBLICATIONS

GB2000100.4 Combined Search and Examination Report dated Jan. 23, 2020 (2 pages).

PCT/GB2018/053038 International Search Report and Written Opinion of the International Searching Authority dated Feb. 5, 2019 (12 pages).

* cited by examiner

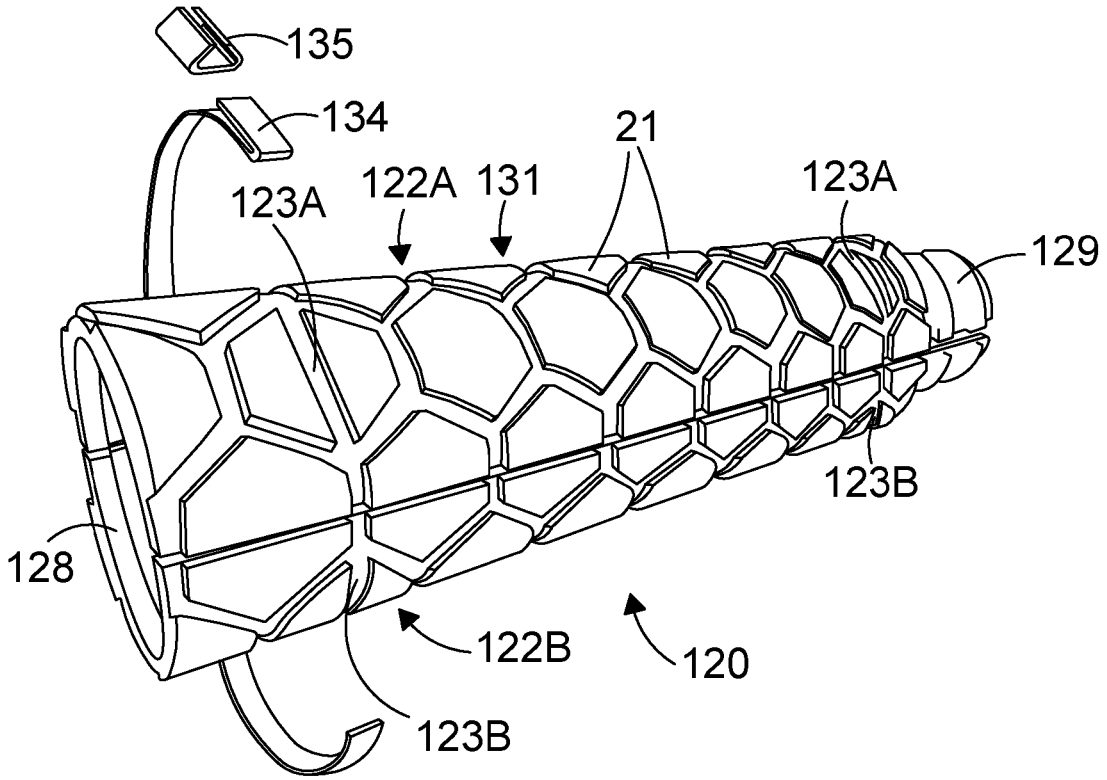
FIG. 10A
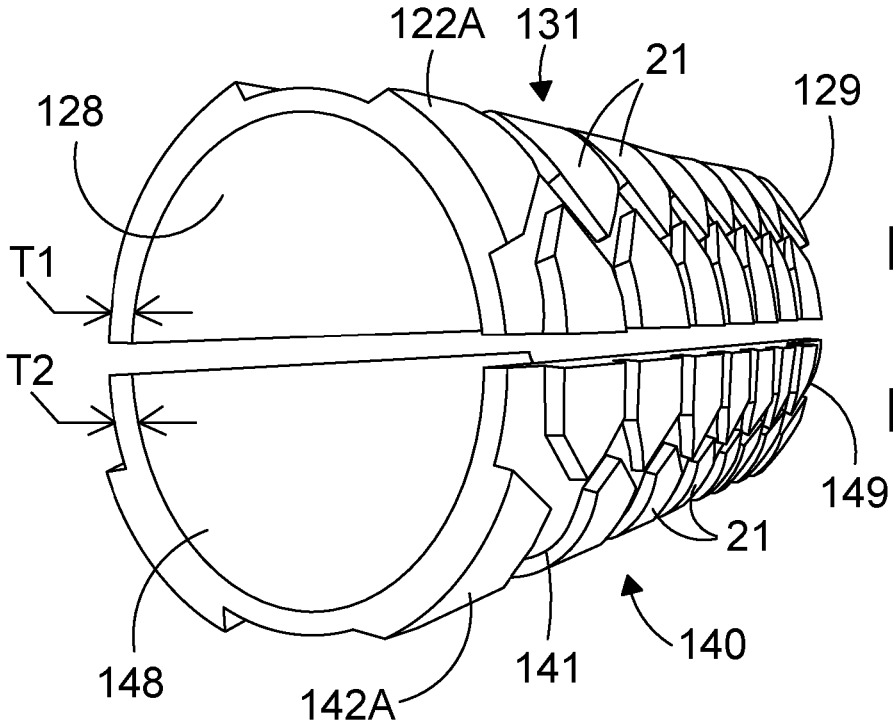
FIG. 10B
FIG. 11A

CYLINDRICAL ELEMENT PROFILED TO REDUCE VORTEX INDUCED VIBRATION (VIV) AND/OR DRAG

CROSS REFERENCE TO RELATED APPLICATIONS

This application is a nationalization of and claims priority to PCT/GB2018/053038, filed on Oct. 19, 2018, which claims priority to GB1811787.9, filed Jul. 19, 2018, and GB1717308.9, filed Oct. 20, 2017, the disclosures of each of which are hereby incorporated by reference in their entirety.

FIELD OF THE INVENTION

The present invention is related to preventing Vortex Induced Vibration (VIV)—and reducing drag occurring on substantially cylindrical objects when they are positioned within a body of water and/or are operating within a water current flow such as in an offshore environment. Such cylindrical objects are typically:

- Distributed buoyancy modules (DBM);
- Drill Riser Buoyancy (DRB); and
- Cylindrical shrouds traditionally used as VIV strakes and which can be retro-fitted onto the outer surface of existing DRB modules already installed in water, where said existing DRB module currently has no VIV reduction associated therewith (or if it does, the operator wishes to replace such existing VIV reduction with an improved version).

BACKGROUND OF THE INVENTION

In fluid dynamics, vortex-induced vibrations (VIV) are motions induced on bodies interacting with an external fluid flow, produced by—or the motion producing—periodical irregularities on this flow.

A classic example is the VIV of an underwater cylinder. A skilled person can very simply observe how this happens in basic terms by putting a cylinder into the water (such as water held in a swimming-pool or even a bucket) and moving it through the water in the direction perpendicular to its axis. Since real fluids always present some viscosity, the flow around the cylinder will be slowed down while in contact with its surface, forming the so-called boundary layer. At some point however, this boundary layer can separate from the body because of its excessive curvature. Vortices are then formed changing the pressure distribution along the surface. When the vortices are not formed symmetrically around the body (with respect to its mid-plane), different lift forces develop on each side of the body, thus leading to motion transverse to the flow. This motion changes the nature of the vortex formation in such a way as to lead to a limited motion amplitude (differently than from what would be expected in a typical case of resonance).

It is therefore important to reduce or minimise VIV on cylindrical objects when they are positioned within and operating in the water column typically between and possibly from the water surface to the seabed within a water current flow such as in an offshore environment.

Conventionally, it is known to attempt to reduce VIV in a number of ways. For example, Matrix Composites and Engineering of Henderson, Wash., 6166, Australia produce the MATRIX LGS™ system (which is described in PCT Patent Publication No WO2016/205900) and which comprises a cylindrical element placed around a cylindrical structure deployed in a body of water (such as a marine riser, umbilical, cable or pipeline) where the cylindrical element comprises a plurality of longitudinally extending raised body portions which are adapted to reduce VIV.

Also, Trelleborg of Houston, Tex. 77073, USA jointly with Diamond Offshore Drilling, Inc. of Houston, Tex. 77094-1810, USA produce a Helical Buoyancy system which is arranged to be placed around a cylindrical structure deployed in a body of water which requires buoyancy support (such as Marine Drilling Risers, Intervention Risers, Jumpers, Long Pipeline Spans, Production Risers, Umbilicals, Flow Lines and Power Cables) where the Helical Buoyancy system comprises a cylinder made up of two half shells formed from buoyant material and where the cylinder is placed around the structure to be supported in the body of water and where the cylinder comprises helical grooves formed on its outer surface along its length. Further details of the Helical Buoyancy System may be viewed in U.S. Pat. Nos. 8,443,896 B2 and 9,322,221 B2.

SUMMARY OF THE INVENTION

According to the present invention, there is provided a generally cylindrical element adapted for immersion in a body of water, the generally cylindrical element having an outer surface arranged, in use, to be in contact with the water, the outer surface comprising:—

- at least two rows of repeating shapes provided thereon,
- each row of repeating shapes being separated from each adjacent row by a groove arrangement and each shape within a row being separated from adjacent shapes by at least one groove;
- wherein the outer surface of the generally cylindrical element reduces Vortex Induced Vibration (VIV) and/or drag acting upon the generally cylindrical element.

Preferably, each of the repeating shapes within each row is identical. This has the advantage of maximising the number of shapes within each row.

Preferably, each row provided on the outer surface comprises identical repeating shapes to the shapes of each other row, such that all of the shapes provided on the outer surface are identical.

The shapes may be triangles, squares, rectangles or pentagons but most preferably the shapes are hexagonal. This provides the advantage of maximising the total number of shapes for a given surface area provided on the outer surface. Most preferably, the said given surface area comprises a hexagonal tessellation. This provides the further advantage that the hexagonal patterns produce a more favourable flow pattern which improves the VIV suppression efficiency; there are several reasons for this but one of the main or most important reasons is that the hexagonal patterns and surrounding groove arrangement provide a plurality of flow separation points whilst minimising drag on the generally cylindrical element.

Preferably, the majority of the outer surface and more preferably the entire outer surface of the generally cylindrical element comprises a hexagonal tessellation in which each three adjacent hexagons meet at each adjoining vertex and the rest of the hexagons repeat that arrangement across the whole outer surface of the generally cylindrical element.

Typically, the vertex between two adjacent sides of each shape, preferably each hexagon shape, comprises a radius and preferably not a sharp corner and more preferably, each vertex between each adjacent pair of sides of each hexagon shape comprises a radius between 5 mm and 250 mm and more preferably said radius is between 150 mm and 250 mm.

Typically, the arrangement of hexagons comprises rows of hexagons stacked with respect to one another, each row being separated from the next upper or lower row by an arrangement of grooves.

Additionally or alternatively, the arrangement of hexagons on the outer surface of the generally cylindrical element can be considered to be in the form of staggered columns equi-spaced around the circumference of the outer surface, where any one column closely fits with the next adjacent column (albeit which is staggered by half the height of a hexagon when compared with the first column) and so on for other columns circumscribing the generally cylindrical element.

The skilled person will understand that the outer surface having such a hexagonal tessellation provided thereon, where the hexagons project outwardly from the outer surface due to the groove arrangements, provide the great advantage of maximising the number of shapes within each row and/or column and/or over the whole of the outer surface and this therefore has the great advantage of providing the most efficient VIV and/or drag reduction possible to the generally cylindrical element.

Preferably, the generally cylindrical element is further adapted to be placed around a substantially cylindrical structure which in use is located in the body of water, where the cylindrical structure may be a riser, umbilical, jumper, long pipeline span, flow line, power cable or the like.

The generally cylindrical element may be a Distributed Buoyancy Module (DBM), Drill Riser Buoyancy (DRB) or may be in the form of a cylindrical shroud used as a VIV strake. When the cylindrical element is a Distributed Buoyancy Module (DBM) or a Drill Riser Buoyancy (DRB) it is typically provided in the form of multiple part shells such as two semi-circular shells or four quarter-circular shells which when brought together envelope the substantially cylindrical structure located in the body of water and which typically comprise buoyancy to aid floatation of the substantially cylindrical structure located in the body of water.

Typically, when the generally cylindrical element is a DRB, it further comprises stacking flats to permit individual shells to be stacked one on top of another.

Typically, when the generally cylindrical element is a DBM it further comprises strap and/or lifting holes to assist transportation of the DBM.

When the cylindrical element is in the form of a cylindrical shroud used as a VIV strake, it may be manufactured in halves (i.e. in two split semi-circumferential pieces of 180° each, which when brought together wrap around or envelop the cylindrical structure and form a generally cylindrical element). Alternatively, the cylindrical shroud may be manufactured in thirds (i.e. in three split circumferential pieces of 120° each, which when brought together wrap around the cylindrical structure and form a generally cylindrical element). Alternatively, when the cylindrical element is in the form of a cylindrical shroud used as a VIV strake, it may be C shaped in cross section and typically comprises a slit formed along the whole length at one side such that it can be slid over the entire length of the substantially cylindrical structure located in the body of water. When the cylindrical element is in the form of a cylindrical shroud used as a VIV strake, it typically comprises strap recesses and/or socket and spigot/bolt and nut arrangements on each end thereof and/or along the longitudinal length thereof (particularly when it is provided in a ⅓ or a half configuration as discussed above).

Alternatively, the generally cylindrical element may be formed integrally with the substantially cylindrical structure such as a subsea conduit, typically on the outer surface thereof. Optionally, the inner surface or throughbore of the generally cylindrical element is bonded directly to the outer surface of the subsea conduit. Optionally, a protective coating layer may be provided between the inner surface or throughbore of the generally cylindrical element and the outer surface of the subsea conduit typically in a co-axial manner and in this case, the protective coating layer is preferably bonded to the respective surface on each of its outer and inner surfaces.

Typically, ties or straps are provided to prevent the generally cylindrical element from accidental removal from around the substantially cylindrical structure located in the body of water.

Preferably, the said groove arrangements comprise a groove having a depth of profile=0.01 to 0.1 times the outer diameter (OD) of the generally cylindrical element and more preferably the said groove arrangements comprise a groove having a depth of profile=approximately 0.05 times the outer diameter (OD) of the generally cylindrical element.

Preferably, the said groove arrangements comprise a groove having a width of profile=0.04 to 0.3 times the outer diameter (OD) of the generally cylindrical element. More preferably the said groove arrangements comprise a groove having a width of profile=0.25 to 0.3 times the outer diameter (OD) of the generally cylindrical element.

The groove arrangement may comprise a groove having a square or rectangular shape.

The groove arrangement may more preferably comprise angled side faces which may be angled between 40 to 80 degrees to the radius of the generally cylindrical element. In this case, the angled side faces of the groove arrangement may be angled in the region of 60 degrees to the radius of the generally cylindrical element.

Alternatively, the profile of the groove arrangement may be a full round (i.e. semi-circular) where the diameter of the cut can be=0.03 to 0.15 times the outer diameter (OD) of the generally cylindrical element. More preferably the said groove arrangements comprise a groove having a diameter of the cut=0.07 to 0.09 times the outer diameter (OD) of the generally cylindrical element.

Typically, the groove arrangement for each row of shapes comprises an upper groove and a lower groove, where each of the upper and lower grooves encircles the full 360-degree circumference of the generally cylindrical element at that longitudinal cross section such that each of said grooves is continuous around the 360 degrees of the generally cylindrical element (i.e. it has no separate start or end point). This has the significant advantage over conventional helical grooves that the groove arrangements of the present invention do not require to be cut as deep as conventional helical grooves because they provide a much greater coverage of grooves than conventional helical grooves. Additionally, because there is no separate start or end point for the grooves, they provide a much smoother exit point for water leaving contact with the groove arrangement and thus the outer surface of the generally cylindrical element.

The said shapes may comprise corners with radius edges which may range from 5 mm-250 mm and more preferably in the range of 50 mm to 70 mm.

Preferably the groove arrangement provides at least one and preferably a plurality of separated paths to flow of water when navigating around the circumference of the generally cylindrical element such that water flowing around the outside circumference of the generally cylindrical element from one side to another (which would occur when the generally cylindrical element were substantially vertical within a body of water which is flowing past that generally cylindrical element) meets a number of flow separation points. Preferably, said flow separation points comprise corner points of the hexagon shapes, or alternatively the flow separation points may comprise a side portion of the hexagon shapes. Typically, water flowing along the flow path within the groove arrangement from one side of the generally cylindrical element to another will meet a flow separation point at which point it will be separated into a first flow path and a second flow path. Preferably, there are a number of flow separation points provided around the outer surface of the generally cylindrical element and which are preferably encountered by water flowing around 180 degrees of the generally cylindrical element. This flow separation characteristic, particularly provided by the arrangement of shapes being staggered when viewed along each row and/or along each column of hexagonal shapes provides significantly greater flow separation, which in turn greatly reduces the VIV, and this provides significant technical advantages to embodiments of the present invention. Preferably, the point of flow separation comprises a corner of a shape and optionally the point of flow separation is less than 90 degrees such that the water flowing in the groove arrangement is forced to change direction by less than 90 degrees in order to keep the coefficient of drag of the generally cylindrical element as low as possible. Optionally the point of flow separation may be 60 degrees such that the water flowing in the groove arrangement is forced to change direction by 60 degrees no matter which of the two paths the water takes around the hexagon shape and thus the coefficient of drag of the generally cylindrical element is kept as low as possible.

Preferably, the depth of the repeating shapes is substantially equal to the Radius of the corner at the edge of each shape.

Optionally, the width of the groove in the circumferential direction is substantially equal to the outermost radius of the element multiplied by 0.50 to 0.60. Further optionally, the width of groove in the diagonal direction is substantially equal to the outermost radius of the element multiplied by 0.55 to 0.60.

Preferably, the repeating shape angle comprises an equal sided and uniformly shaped hexagon, having the enclosed angle of each corner fixed at 120 degrees.

Preferably, the shape pattern comprises multiple rows of 3 fixed 120° enclosed angle hexagons equi-spaced per row around the circumference of the generally cylindrical element, optionally with the adjacent row comprising 3 similarly shaped hexagons but offset by half a pitch out of phase (i.e. 60°).

The accompanying drawings illustrate presently exemplary embodiments of the disclosure and together with the general description given above and the detailed description of the embodiments given below, serve to explain, by way of example, the principles of the disclosure.

In the description that follows, like parts are marked throughout the specification and drawings with the same reference numerals, respectively. The drawings are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments of the present invention are shown in the drawings and herein will be described in detail, with the understanding that the present disclosure is to be considered an exemplification of the principles of the invention and is not intended to limit the invention to that illustrated and described herein. It is to be fully recognized that the different teachings of the embodiments discussed below may be employed separately or in any suitable combination to produce the desired results.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one embodiment can typically be combined alone or together with other features in different embodiments of the invention. Additionally, any feature disclosed in the specification can be combined alone or collectively with other features in the specification to form an invention.

Various embodiments and aspects of the invention will now be described in detail with reference to the accompanying figures. Still other aspects, features and advantages of the present invention are readily apparent from the entire description thereof, including the figures, which illustrates a number of exemplary embodiments and aspects and implementations. The invention is also capable of other and different embodiments and aspects, and its several details can be modified in various respects, all without departing from the scope of the present invention.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

Accordingly, the drawings and descriptions are to be regarded as illustrative in nature and not as restrictive. Furthermore, the terminology and phraseology used herein is solely used for descriptive purposes and should not be construed as limiting in scope. Language such as "including", "comprising", "having", "containing" or "involving" and variations thereof, is intended to be broad and encompass the subject matter listed thereafter, equivalents and additional subject matter not recited, and is not intended to exclude other additives, components, integers or steps. In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including" or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

All numerical values in this disclosure are understood as being modified by "about". All singular forms of elements, or any other components described herein including (without limitations) components of the apparatus described herein are understood to include plural forms thereof and vice versa.

BRIEF DESCRIPTION OF THE DRAWINGS

Embodiments of the present invention will now be described, by way of example only, with reference to the accompanying drawings, in which:—

FIG. 6(*g*) is a further perspective view of the most preferred tessellation pattern applied on the generally cylindrical element of FIGS. 4(*d*), 5(*d*) and 6(*d*), particularly showing dimension examples;

FIG. 7(*b*) is a perspective view from above of one of the semi-circular half shells which when connected to another matching semi-circular half shell together form the DBM of FIG. 7(*a*);

FIG. 7(*c*) is a side view of the semi-circular half shell of FIG. 7(*b*);

FIG. 7(*d*) is a perspective view from below of the semi-conductor half shell of FIG. 7(*b*).

FIG. 8(*b*) is the DRB and drill riser/conductor arrangement of FIG. 8(*a*), but with one semi-circular half shell of one section of the DRB removed to aid clarity of understanding of the skilled person;

FIG. 8(*c*) is the DRB and drill riser/conductor arrangement of FIG. 8(*b*) but only showing the section where the one half semi-circular shell of the one section of the DRB has been removed;

FIG. 8(*d*) is a close up view of the upper exposed end of the DRB and drill riser/conductor arrangement of FIG. 8(*a*);

FIG. 8(*e*) is a perspective view of one section of DRB shown in isolation;

FIG. 8(*f*) is a perspective view of one (outer) side of one semi-circular half shell of the one section of DRB shown in FIG. 8(*e*);

FIG. 8(*g*) is a perspective view of the other (inner) side of the semi-circular half shell of the DRB shown in FIG. 8(*f*);

FIG. 8(*h*) is a cross-sectional view through the DRB of FIG. 8(*e*);

FIG. 8(*i*) is a close up side view of one hexagonal shape and surrounding groove arrangement as provided on the outer surface of the DRB of FIG. 8(*a*);

FIG. 8(*j*) is a cross-sectional view of a first example of a groove of the groove arrangement provided on the outer surface of the DRB of FIG. 8(*a*) as having a rectangular or square profile (i.e. a "U" shaped profile);

FIG. 8(*k*) is a cross-sectional view of a second example of a groove of the groove arrangement provided on the outer surface of the DRB of FIG. 8(*a*) as having a tapered/angled side face profile (i.e. a cross between a "U" and a "V" shaped profile);

FIG. 8(*l*) is a cross-sectional view of a third example of a groove of the groove arrangement provided on the outer surface of the DRB of FIG. 8(*a*) as having a semi-circular or full rounded profile;

FIGS. 10(*a*) and 10(*b*) are perspective views of a further embodiment of a generally cylindrical element adapted for submerging in a body of water and being profiled to reduce Vortex Induced Vibration (VIV) and/or drag, in accordance with the present invention, and particularly in the form of a two semi-circular part shells which when brought together around a subsea conduit such as a pipe can be strapped to one another (either at the time of first installation of such a conduit subsea or as retrofitting to an already subsea installed such conduit) to act as a cylindrical shroud to the subsea conduit.

DETAILED DESCRIPTION OF THE EMBODIMENTS OF THE INVENTION

Figure 1:
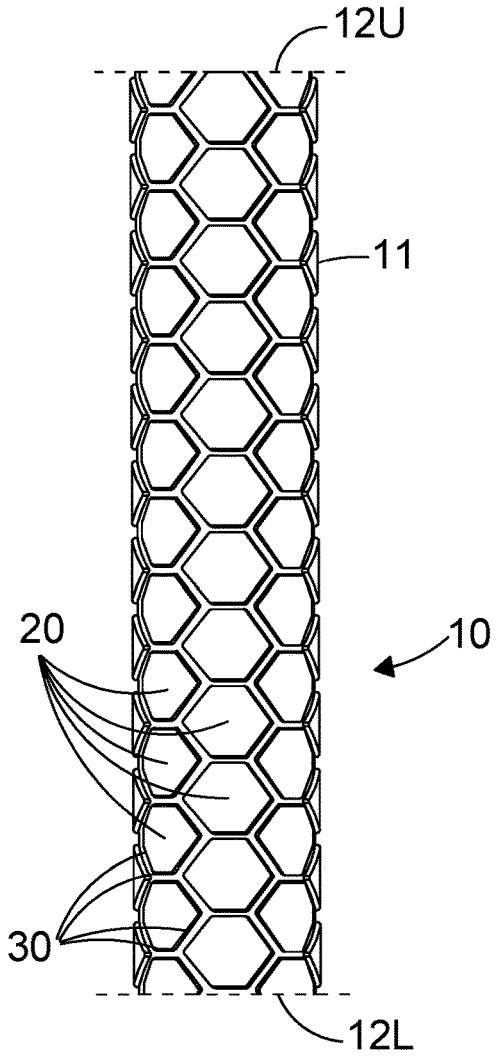
FIG. 1 is a side view of a first embodiment of a generally cylindrical element adapted for submerging in a body of water and being profiled to reduce Vortex Induced Vibration (VIV) and/or drag, in accordance with the present invention.

FIG. 1 shows an embodiment of a generally cylindrical element 10 adapted for immersion in a body of water (not shown) and which is in accordance with the present invention. The generally cylindrical element 10 is substantially tubular and comprises a throughbore 15 and an outer surface 11.

In certain embodiments of the present invention, the generally cylindrical element 10 may be the actual (i.e.

integral) outer surface of a substantially cylindrical structure (not shown) which in use is located in the body of water, where the substantially cylindrical structure may be a riser (not shown), umbilical, jumper, long pipeline span, flow line, power cable or the like. Alternatively and more preferably, the substantially cylindrical element 10 is a separate substantially tubular component to the said substantially cylindrical structure (not shown), wherein in use the substantially cylindrical element 10 is adapted to be placed around the said generally cylindrical structure such that the generally cylindrical structure is located within the throughbore 15 of the generally cylindrical element 10 such that the generally cylindrical element 10 envelops the section of the said generally cylindrical structure located within it and therefore acts like a sleeve to the generally cylindrical structure located within it.

Importantly, in all embodiments, the generally cylindrical element 10 is provided with an arrangement or pattern of repeating shapes 20 on its outer surface 11, as will be described in more detail subsequently and which acts to reduce the Vortex Induced Vibration (VIV) and/or drag acting upon the generally cylindrical element 10 (and therefore acts to reduce the VIV and/or drag on any substantially cylindrical structure located within the throughbore 15 of the generally cylindrical element 10).

The skilled person will understand that the combination of the shapes 20 and the arrangement of grooves 30 provided around the shapes 20 alter the way in which vortices (not shown) are formed as compared to a cylindrical structure that has a uniform (flat) outer surface 11. The skilled person will also realise that by providing the generally cylindrical element 10 having the said outer surface 11 will mean that additional (conventional) VIV strakes which would normally additionally be provided around some cylindrical structures or tubulars used subsea will not be required because the generally cylindrical element 10 will provide sufficient and possibly more than sufficient reduction of VIV and/or drag.

As shown in FIG. 1, the generally cylindrical element 10 comprises an upper end 12U and a lower end 12L, and comprises a length sufficient for the deployment within the water as required for the particular application.

In the embodiment as shown in FIG. 1, the outer surface 11 comprises a plurality of repeating shapes 20, where each preferred shape 20 is a hexagon, such that the majority of the outer surface 11 or more preferably the entire outer surface 11 of the generally cylindrical element 10 comprises a hexagonal tessellation 21 in which each three adjacent hexagons 20 (shown in FIG. 3 for example as hexagons 20A, 20B and 20C) meet at each adjoining vertex 22 and the rest of the hexagons 20 repeat that arrangement across the whole outer surface 11 of the generally cylindrical element 10.

The skilled person should note that it is preferred that each vertex 22 between two adjacent sides of each hexagon shape 20 comprises a radius and not a sharp corner and more preferably, each vertex 22 between each adjacent pair of sides of each hexagon shape 20 comprises a radius between 5 mm and 250 mm and more preferably said radius is between 150 mm and 250 mm.

Figure 2:
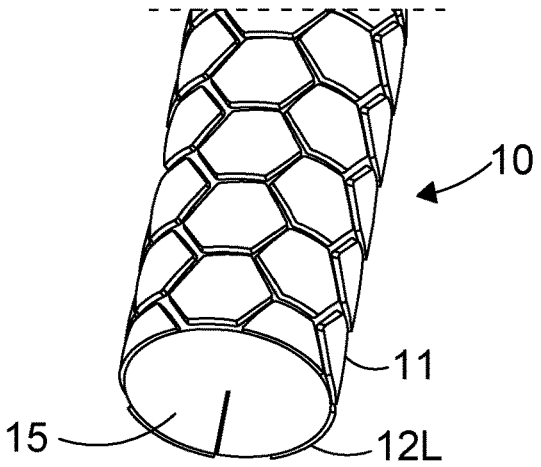
FIG. 2 is a perspective view of an in-use lower most end of the generally cylindrical element of FIG. 1.
Figure 3:
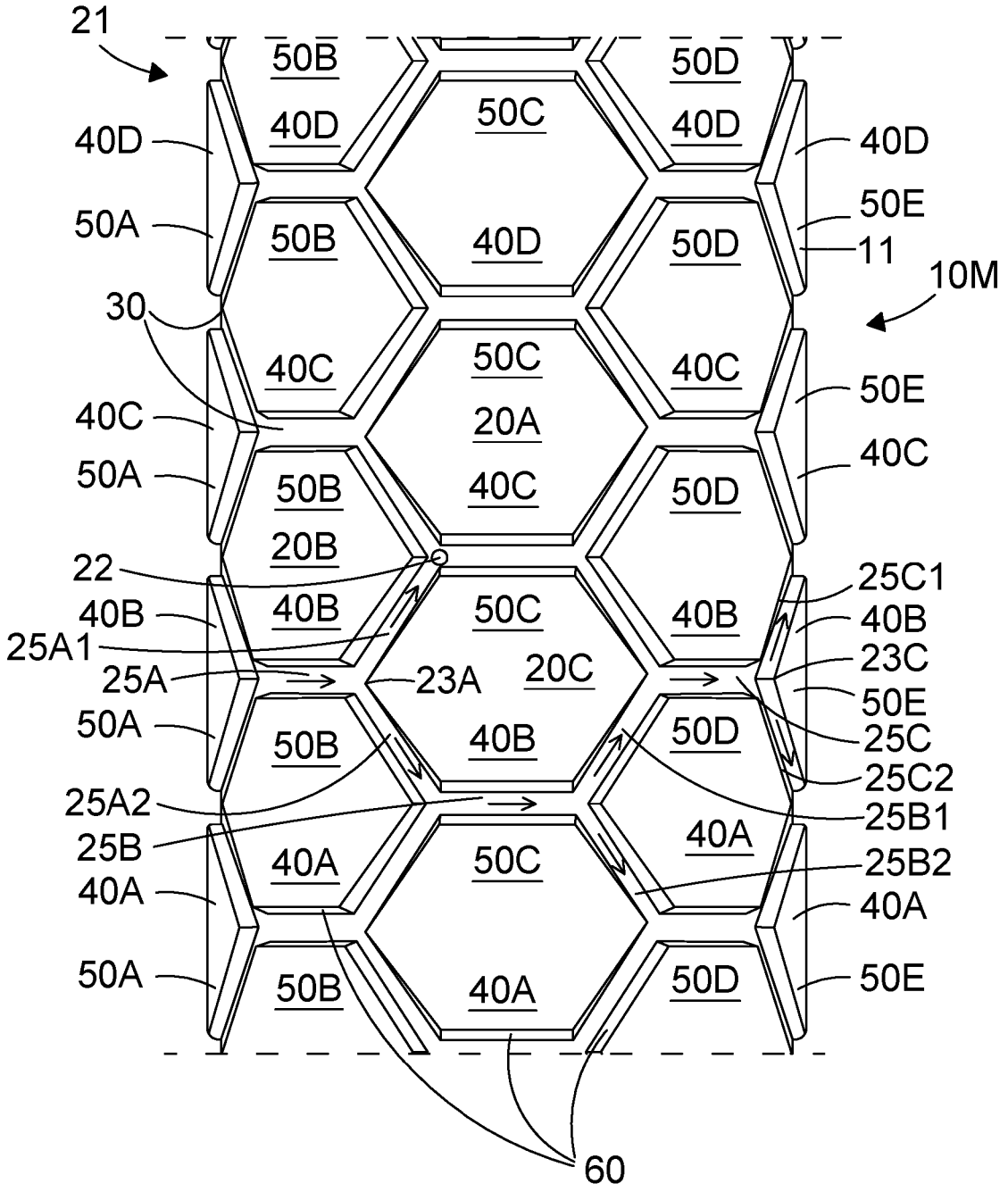
FIG. 3 is a side view of a middle portion 10M of the generally cylindrical element 10 of FIG. 1, showing in more detail the outer surface of the generally cylindrical element 10.
Figure 4C:
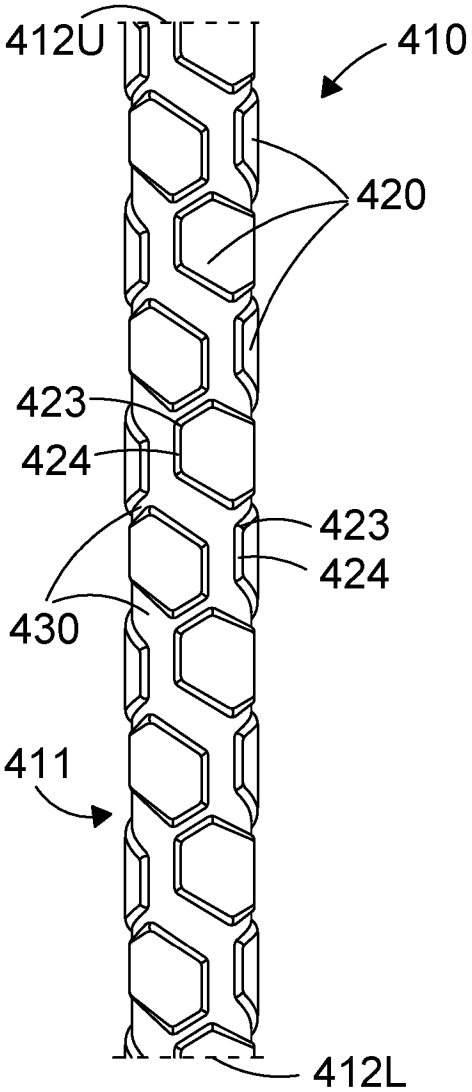
FIGS. 4(*a*)-4(*f*) are 3-dimensional representations of side views of further embodiments of a generally cylindrical element adapted for submerging in a body of water and being profiled to reduce VIV and/or drag, in accordance with the present invention.
Figure 4B:
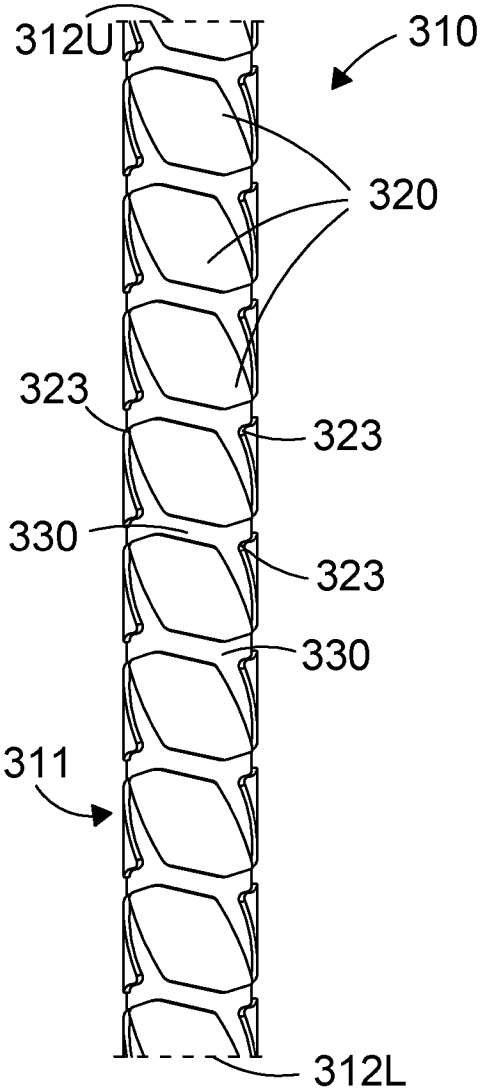
Figure 4A:
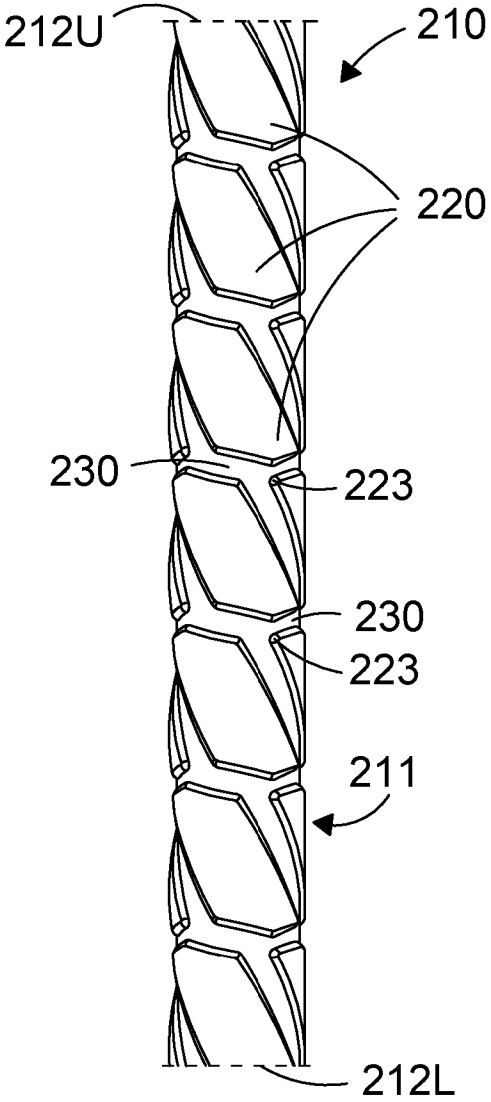
Figure 4F:
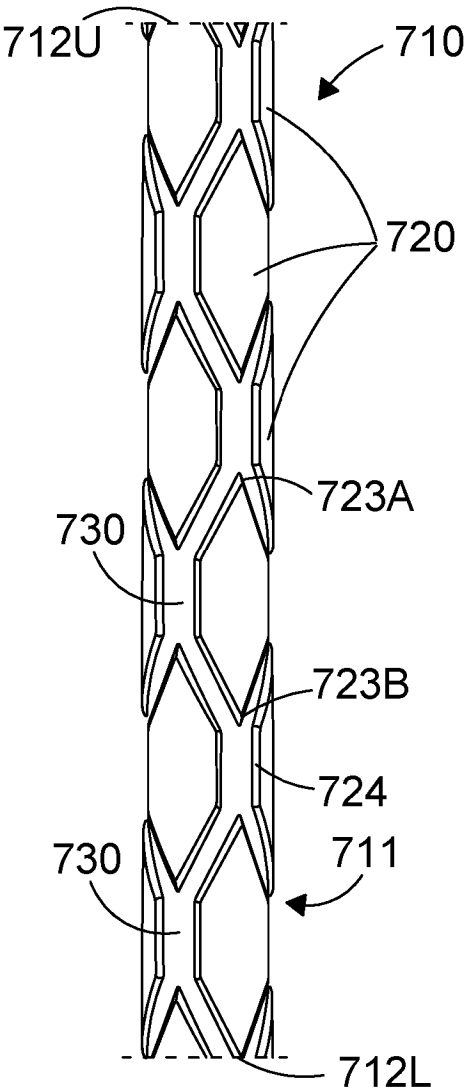
Figure 4E:
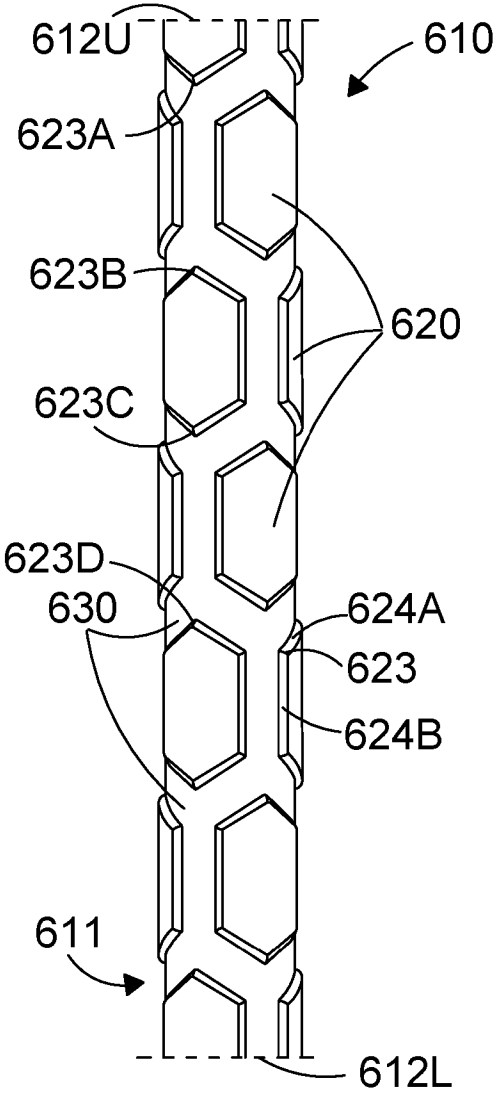
Figure 4D:
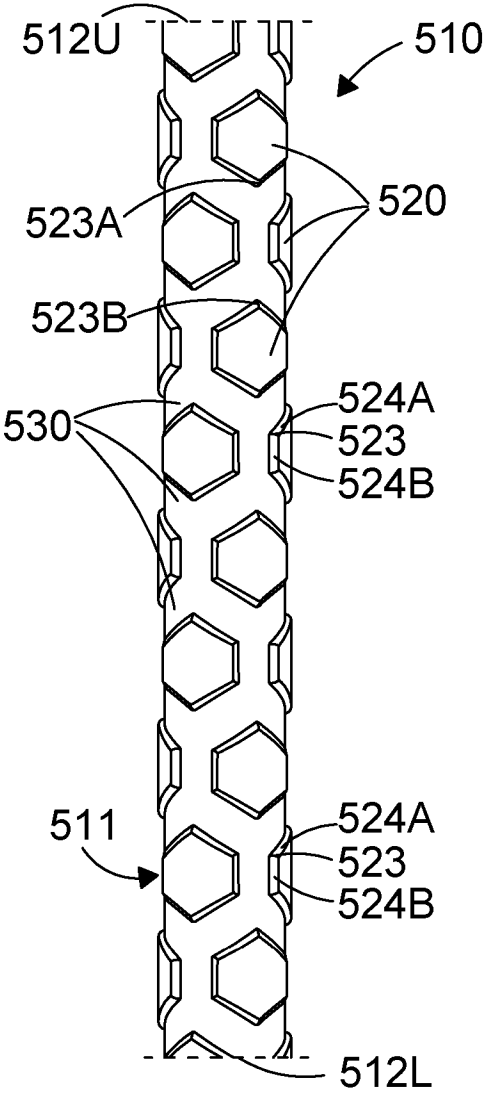
Figure 5C:
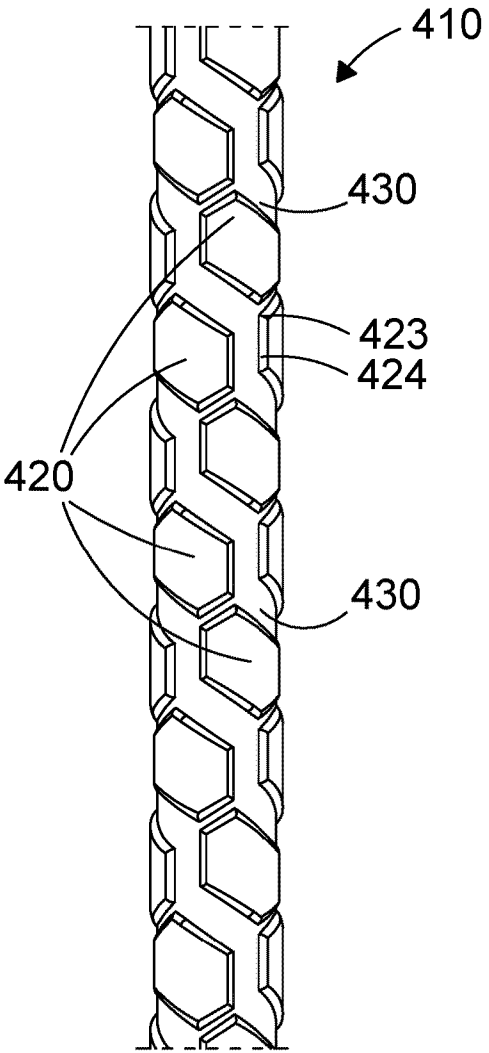
FIGS. 5(*a*)-5(*f*) are line drawings of the side views of FIGS. 4(*a*)-4(*f*)
Figure 5B:
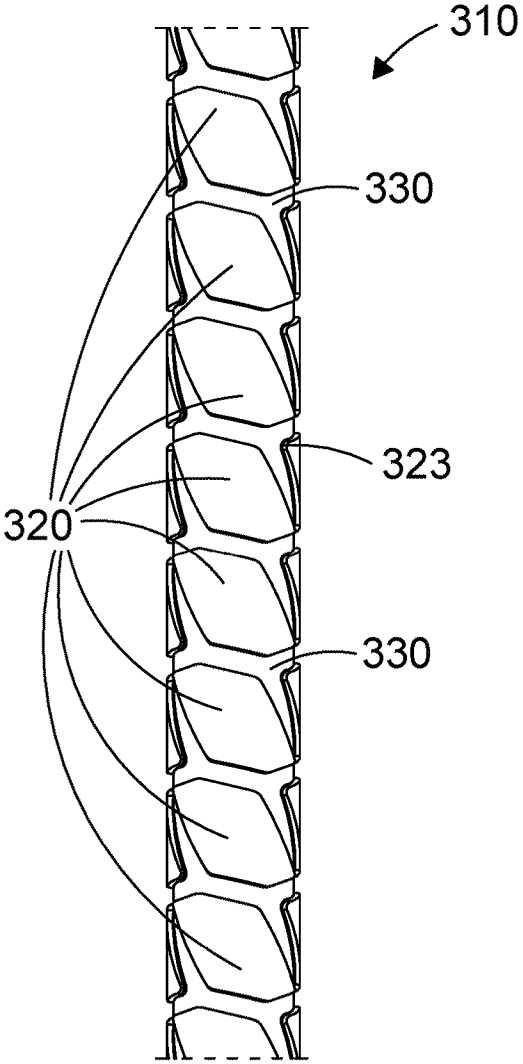
Figure 5A:
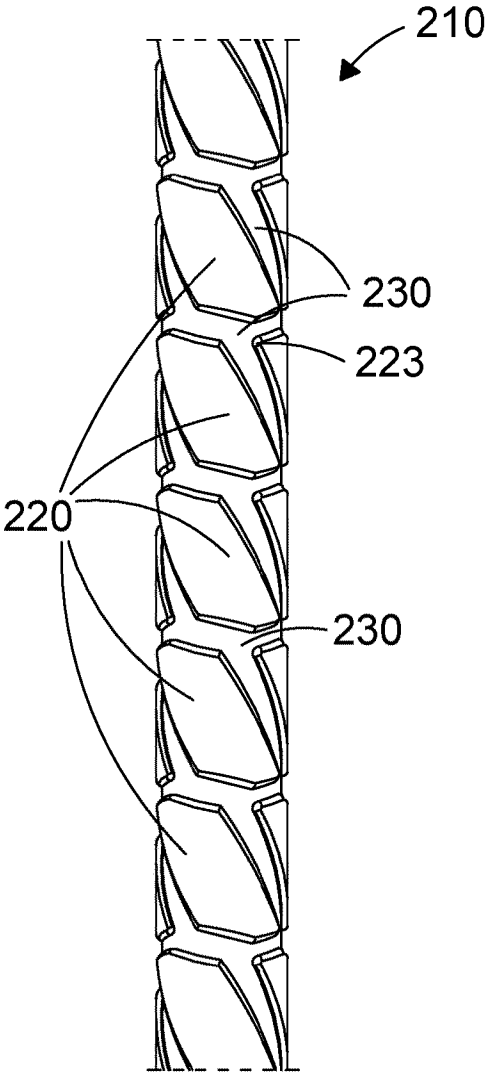
Figure 5F:
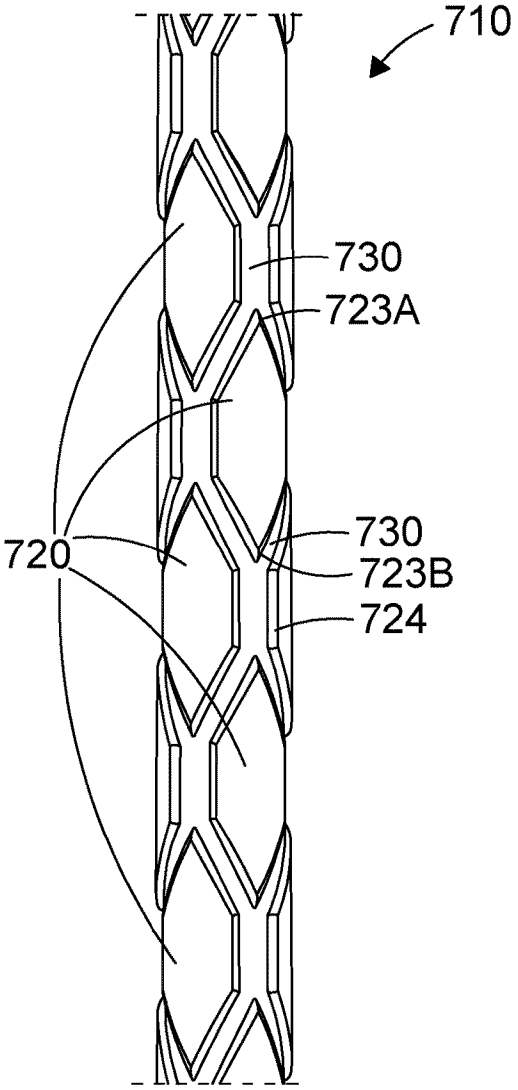
Figure 5E:
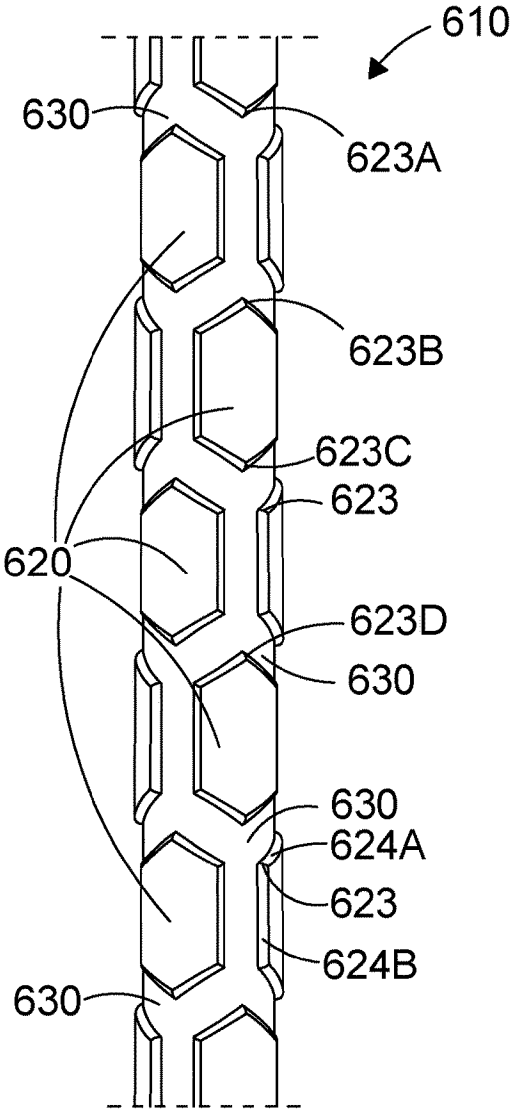
Figure 5D:
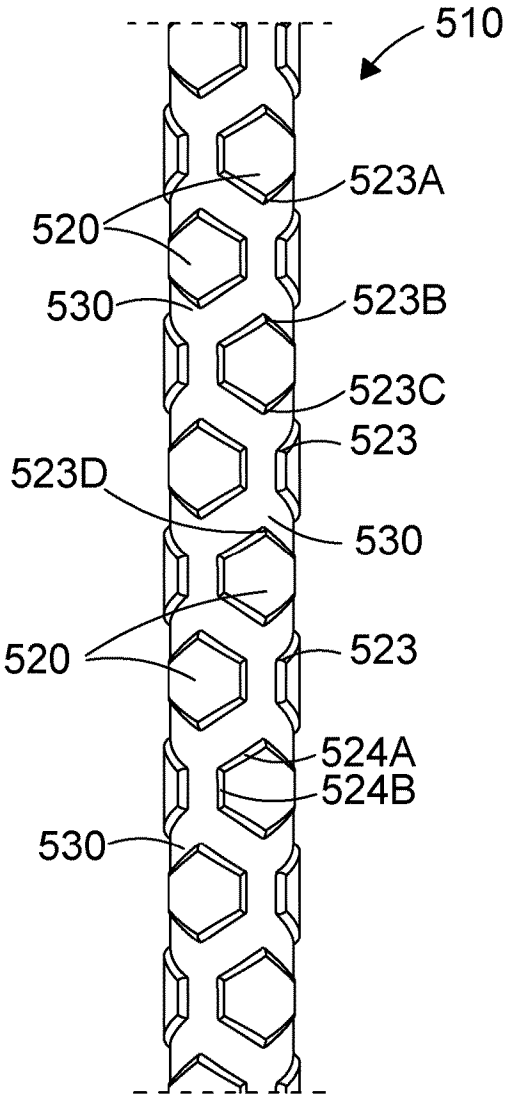
Figure 6A:
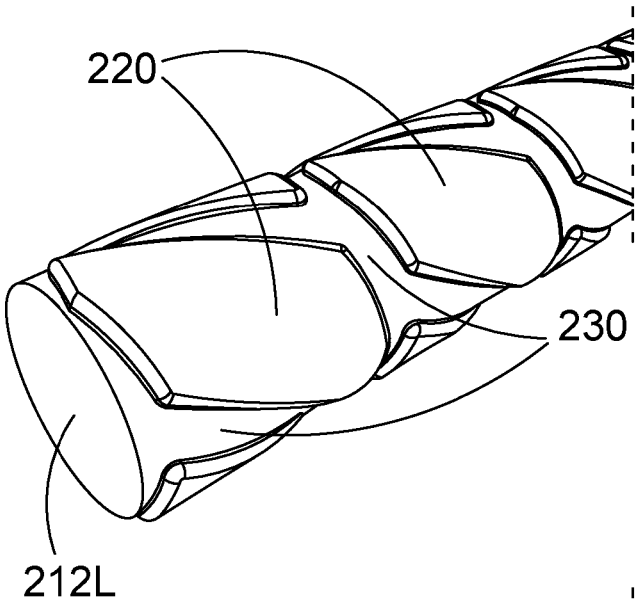
FIGS. 6(*a*)-6(*f*) are perspective views of FIGS. 5(*a*)-5(*f*)
Figure 6B:
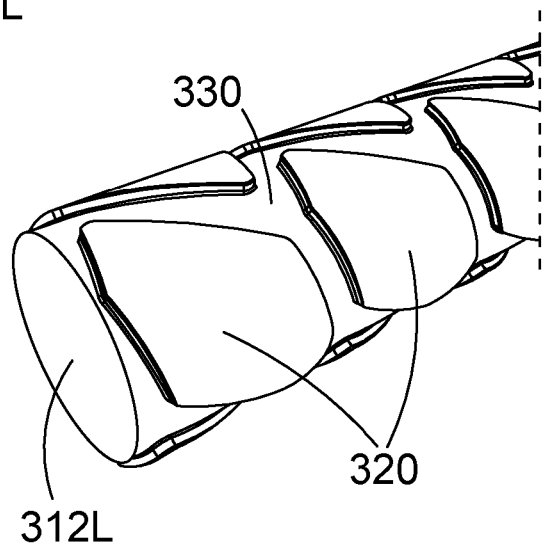
Figure 6C:
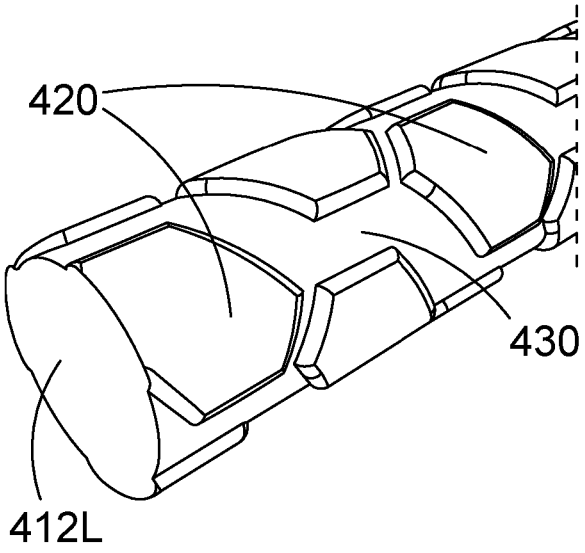
Figure 6D:
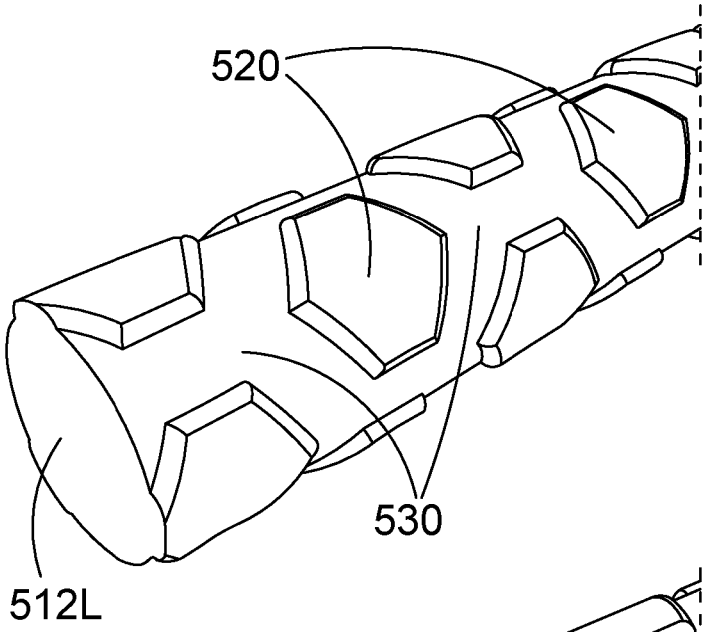
Figure 6E:
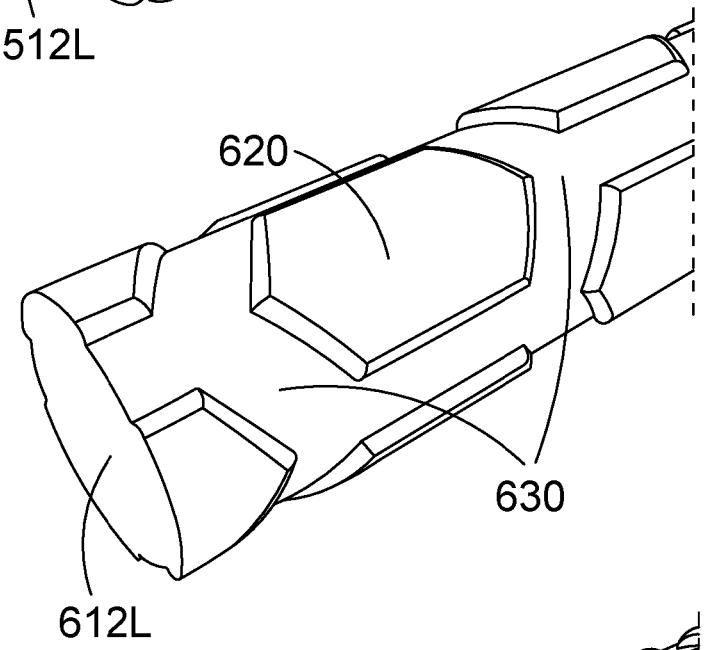
Figure 6F:
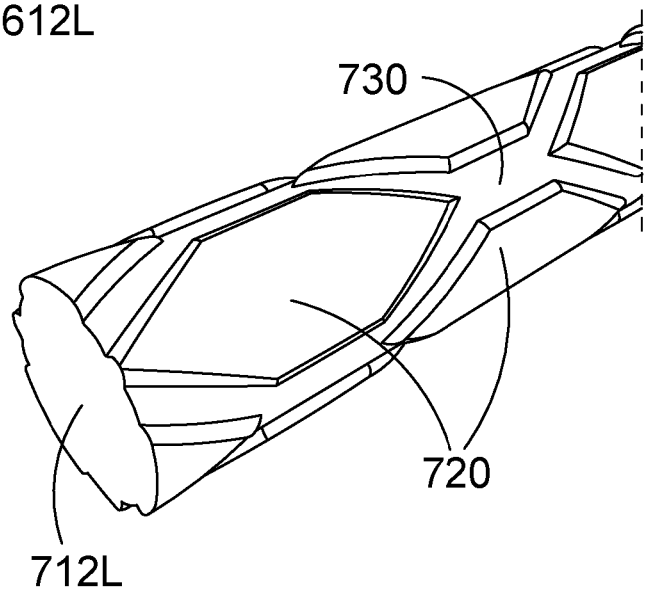
Figure 6G:
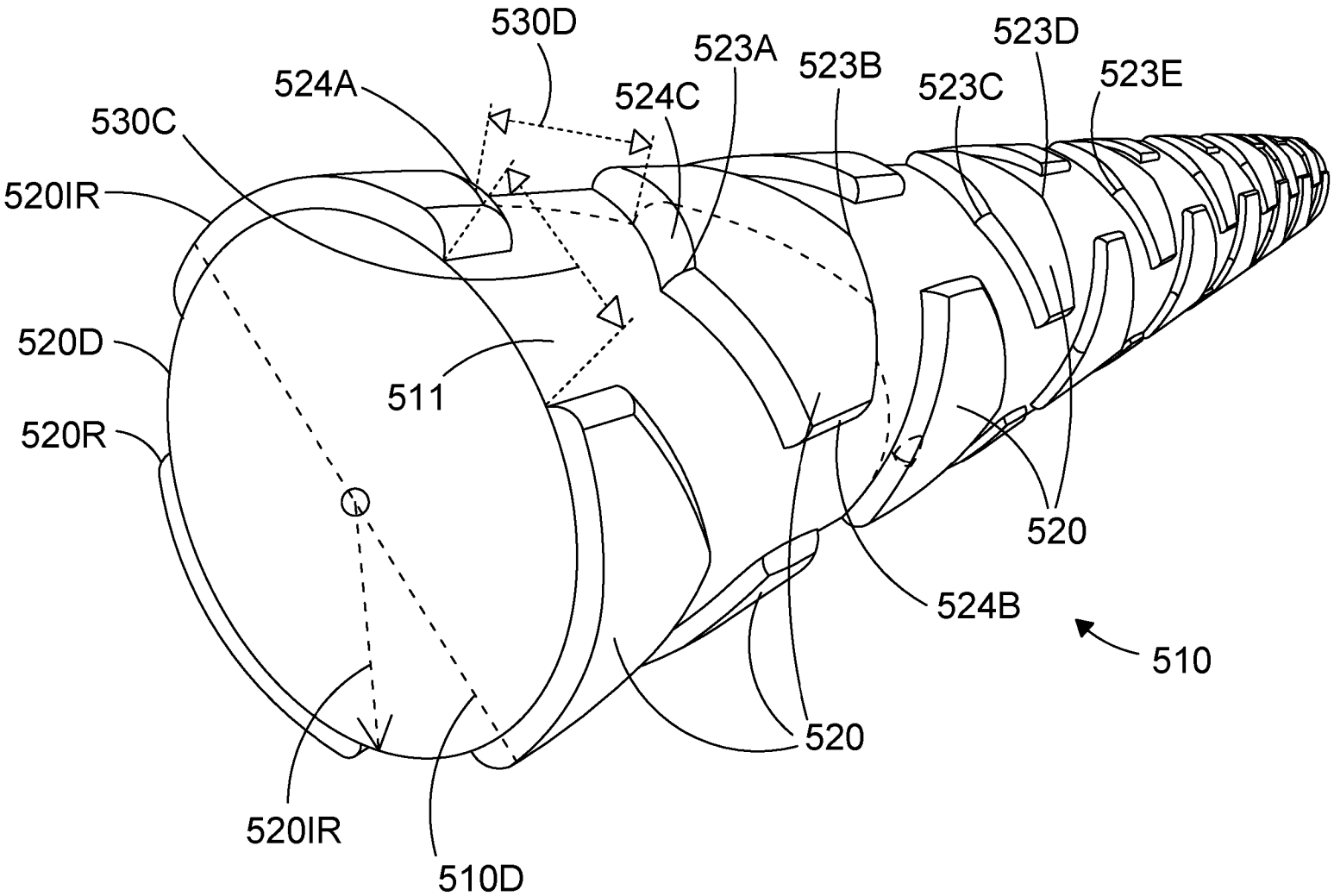
Figure 7A:
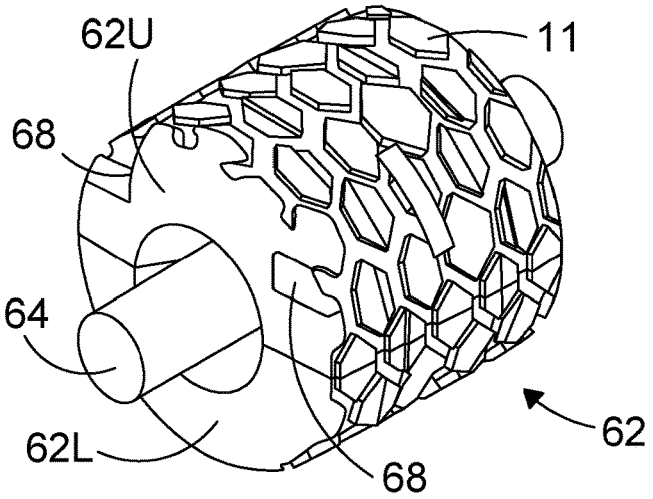
FIG. 7(*a*) is a perspective view of a yet further embodiment of a generally cylindrical element in the form of a Distributed Buoyancy Module (DBM) secured to/around the outer surface of a generally cylindrical structure in the form of a conduit such as a riser located in a body of water, where the DBM is in accordance with the present invention.
Figure 7B:
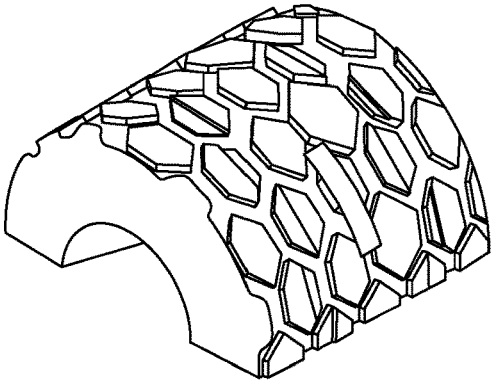
Figure 7C:
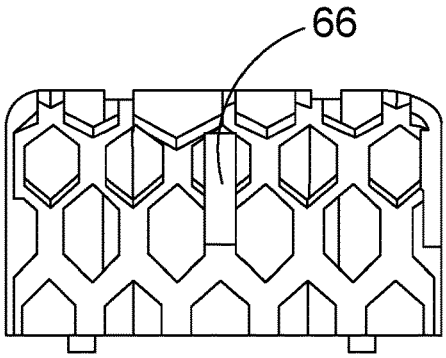
Figure 7D:
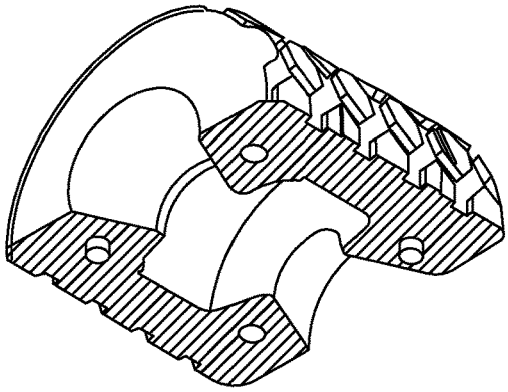
Figure 8A:
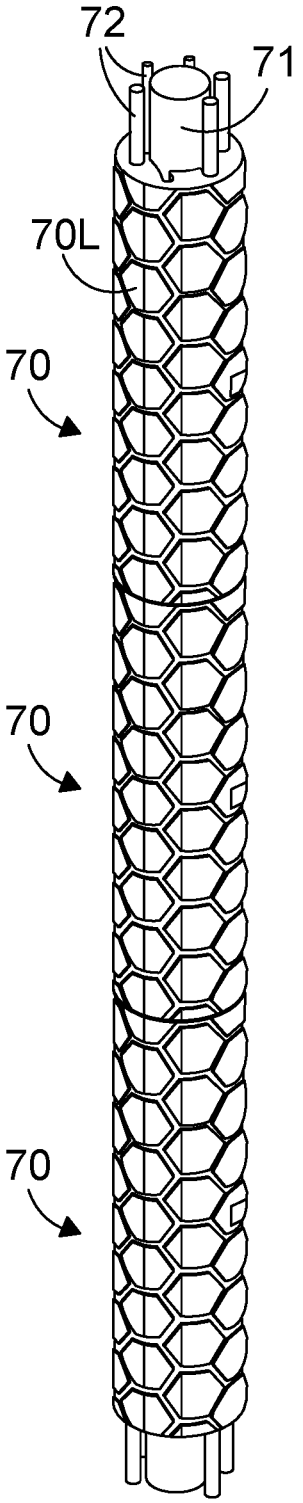
FIG. 8(*a*) is a perspective view of a yet further embodiment of a generally cylindrical element in the form of a Drill Riser Buoyancy (DRB) secured to/around the outer surface of a generally cylindrical structure in the form of an arrangement of a drill riser located in a body of water and five conductors located around the outer circumference of the drill riser, where the DRB is in accordance with the present invention.
Figure 8B:
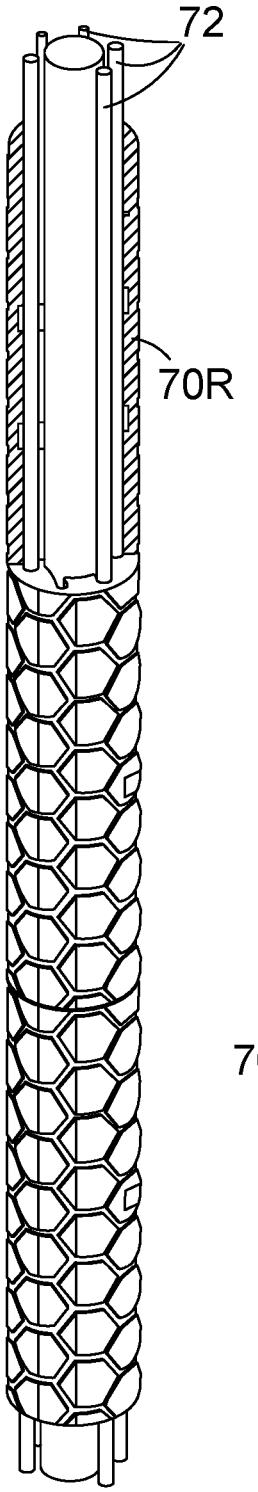
Figure 8C:
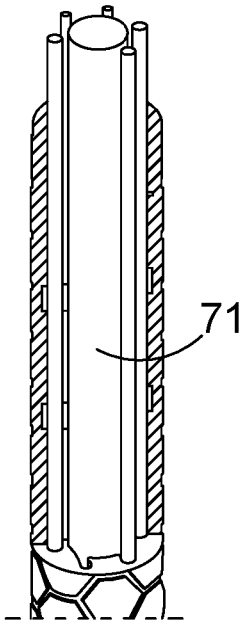
Figure 8D:
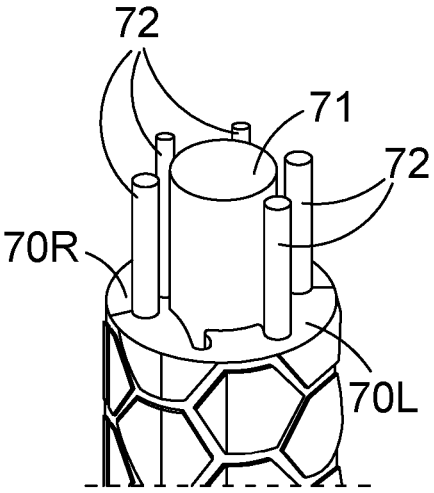
Figure 8E:
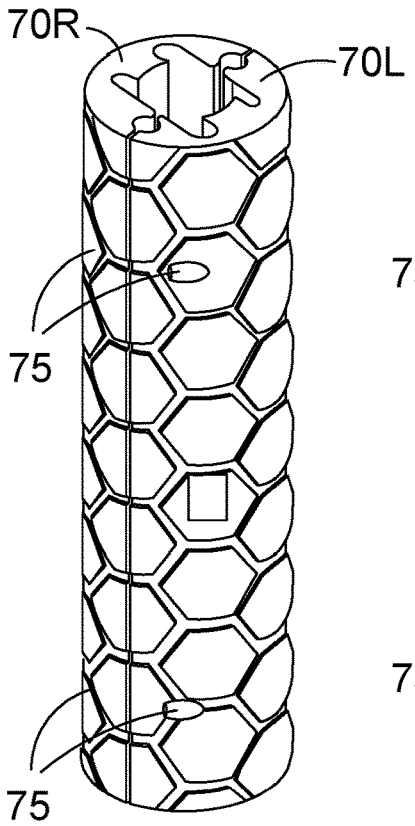
Figure 8F:
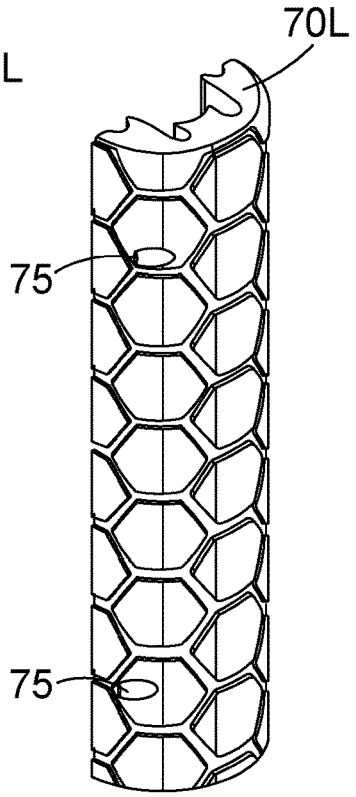
Figure 8G:
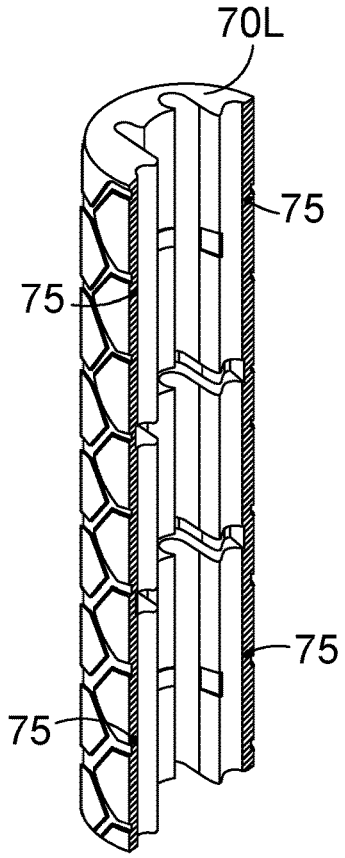
Figure 8H:
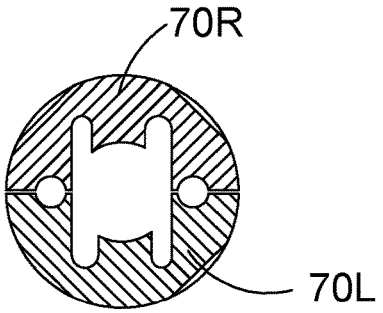
Figure 8I:
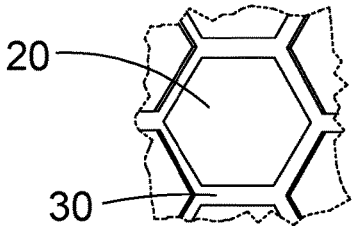
Figure 8J:
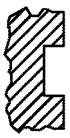
Figure 8K:
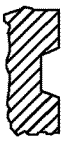
Figure 8L:
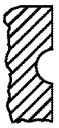

In the embodiment of the generally cylindrical element 10 as shown in FIGS. 1-3, the arrangement of hexagons 20 can also be considered in terms of rows 40A, 40B, 40C, 40D of hexagons 20 stacked on top of one another, each row 40 being separated from the next upper or lower row 40 by an arrangement of grooves 30.

Additionally, the arrangement of hexagons 20 on the outer surface 11 of the generally cylindrical element 10 can be considered to be in the form of staggered columns 50 equi-spaced around the circumference of the outer surface 11, where the first column 50A shown in FIG. 3 closely fits with the next column 50B (which has been staggered by half the height of a hexagon 20 when compared with the first column 50A) and so on for the other columns 50C, 50D and 50E as shown in FIG. 3.

The skilled person will understand that the outer surface 11 having such a hexagonal tessellation 21 provided on itself, where the hexagons 20 project outwardly from the outer surface 11 due to the groove arrangements 30, provide the great advantage of maximising the number of shapes 20 within each row 40 and/or column 50 and/or over the whole surface of the outer surface 11 and this therefore has the great advantage of providing the most efficient VIV and/or drag reduction possible to the generally cylindrical element 10.

The shapes 20 and the groove arrangements 30 may be formed on the outer surface 11 of the generally cylindrical element 10 by any suitable means such as moulding the generally cylindrical element 10 as an integral one-piece component with the groove arrangement 30 and hexagonal tessellation 21 provided thereon (and such a moulding operation could be a pumped, injected or roto-moulded operation). Alternatively, the generally cylindrical element 10 may start out as a homogeneous tubular and the groove arrangements 30 may be cut into the outer surface of the homogeneous tubular (not shown) in order to form the arrangement of shapes 20 and in particular the preferred arrangement of the hexagonal tessellation 21 provided on the outer surface 11. Other suitable manufacturing techniques could also be used. A less preferred manufacturing technique is having a homogeneous tubular and fixing by some suitable fixing means such as adhesive or screws etc. the shapes 20 to the outer surface 11 of the homogeneous tubular (not shown) in such a hexagonal tessellation 21 arrangement such that the groove arrangements 30 are provided by the resulting gaps or channels between the various fixed shapes 20.

The hexagonal tessellation 21 is very efficient at reducing the VIV and indeed it is designed to reduce the VIV by a minimum of 80% and also reduce the drag below 1.2 for Reynolds numbers ranging from 1.4e5 to 4.2e6.

The dimensions of the groove arrangements 30 are as follows:—

- depth of groove profile equals 0.01 to 0.1 times the outer diameter (OD) of the generally cylindrical element 10, with a preferred groove arrangement 30 having a depth of profile equal to 0.0.2 to 0.03 times the OD of the generally cylindrical element 10;
- a width of profile equal to 0.04 to 0.1 times the OD of the generally cylindrical element 10 with a preferred width of profile equal to 0.05 to 0.07 times the OD of the generally cylindrical element 10;
- the groove arrangement 30 typically comprises angled side faces 60 which may be angled between 40 to 80 degrees to the radius of the generally cylindrical element 10 and preferably the angled side faces 60 of the groove arrangement 30 are angled in the region of 60 degrees to the radius of the generally cylindrical element 10;
- alternatively, the profile of the groove arrangement 30 may be a full round where the diameter of the cut can be equal to 0.03 to 0.15 times the OD of the generally cylindrical element 10 and more preferably the said groove arrangements 30 when arranged with a full round comprise a groove having a diameter of the cut equal to 0.07 to 0.09 times the OD of the generally cylindrical element 10.

The skilled person will therefore understand that the hexagonal tessellation 21 (and therefore each row 40 and/or each column 50 within the hexagonal tessellation 21) encircles the full 360-degree circumference of the generally cylindrical element 10 and will further understand that each groove 30 at the upper and lower sides of each row 40 is continuous around the 360 degrees of the outer surface 11 such that it has no separate start or end point. This provides significant advantages in terms of VIV reduction and/or drag reduction because the groove arrangement 30 provides a much smoother exit point for water leaving contact with the outer surface 11 (when compared to a completely "smooth" outer surface).

The skilled person will also realise that, whilst the hexagonal tessellation 21 is the most preferred shape profile provided on the outer surface 11, other less preferred shapes 20 could also be used such as triangles, square, rectangles, pentagons or other suitable shapes. The more preferred suitable shapes are shapes having symmetry (and which are therefore capable of being closely fit together in a tessellation). It is also preferred that all of the shapes 20 within the tessellation 21 are identical to one another in order to increase the number of shapes 20 that can be fit or provided on the outer surface 11 and therefore whilst different shapes could be provided within separate rows 40, it is preferred that all of the shapes 20 within a tessellation are identical and it is most preferred that all of the shapes are hexagons 20 and therefore the tessellation is a hexagonal tessellation 21. It is further preferred that the groove arrangement 30 provides at least one and preferably a plurality of separated paths to flow of water when navigating around the circumference of the generally cylindrical element 10 such that water following around the outside circumference of the generally cylindrical element 10 from one side to another (which would occur when the generally cylindrical element 10 were substantially vertical within a body of water which is flowing past that generally cylindrical element 10) meets a number of flow separation points 23 in the form of the corner points 23 of the hexagon shapes 20. For example, water flowing along the flow path 25A within the groove arrangement 20 from left to right in FIG. 3 will meet flow separation point 23A at which point it will be separated into flow 25A1 and flow 25A2. In addition, water flowing along the flow path 25B within the groove arrangement 20 from left to right in FIG. 3 will meet flow separation point 23B at which point it will be separated into flow 25B1 and flow 25B2. As a further example, water flowing along the flow path 25C within the groove arrangement 20 from left to right in FIG. 3 will meet flow separation point 23C at which point it will be separated into flow 25C1 and flow 25C2. This flow separation characteristic, particularly provided by the arrangement of shapes 20 being staggered when viewed along each row 40 and/or along each column 50 provides significantly greater flow separation and which in turn greatly reduces the VIV and this provides significant technical advantages to embodiments of the present invention. In addition, in this exemplary embodiment of the invention, it is preferred that the point of flow separation 23 (i.e. the corner 23 of the shape) is less than 90 degrees such that the water flowing in the groove arrangement 20 (such as along flow path 25A) is forced to change direction by less than 90 degrees in order to keep the coefficient of drag of the generally cylindrical element 10 as low as possible. Thus in the embodiment employing the hexagonal tessellation 21, the point of flow separation 23 (i.e. the corner 23 of the shape) is 60 degrees such that the water flowing in the groove arrangement 20 (such as along flow path 25A) is forced to change direction by 60 degrees no matter which of the two paths (i.e. path 23A1 or 25A2) the water takes around the hexagon shape 20C and thus the coefficient of drag of the generally cylindrical element 10 is kept as low as possible.

The generally cylindrical element 10 and the shapes 20 provided thereon are formed from any suitable material and the suitable material may be a material which is buoyant within water.

Alternative configurations of the surface tessellation are shown in FIGS. 4-6. For conciseness, where features are the same between all configurations, the details of these will not be repeated and the reader is referred to the paragraphs above. Like features are labelled with the format X10, X11, where the final numerals indicate the feature as labelled in FIGS. 1-3.

FIGS. 4-6*a* show cylindrical element 210 having an outer surface 211 that comprises repeating hexagonal shapes 220, elongated along an axis that is offset from the longitudinal and the transverse axes of the element 210, with rounded points. Between the shapes 220 are grooves 230. The cylindrical element 210 has an upper end 212U and a lower end 212L as before. Water flowing around element 210 within the grooves 230 meets with at least one vertex 223 of the hexagonal shapes 220 and splits along different flow paths. Compared to the configuration of grooves 30 and shapes 20 illustrated in FIGS. 1-3, the water travelling around element 210 will generally always be directed at an offset angle relative to the axes of the cylindrical element 210 (whereas in FIG. 1 for example, it can be seen that some grooves 30 are aligned with the transverse axis or plane of the element 10).

FIGS. 4-6*b* show cylindrical element 310 again having an outer surface 311 comprising elongated hexagonal repeating shapes 320 with rounded points, but the shapes 320 in this example are less elongated than those in FIGS. 4-6*a*. The elongation of the shapes 320 is again along an axis of each shape 320 that is offset from the longitudinal and transverse axes of the cylindrical element 310. As before water flowing along grooves 330 meets with vertices 323 of the shapes 320 and splits into separate flow paths. The grooves 330 are angled with respect to the longitudinal and transverse directions of the element 310.

FIGS. 4-6*c* show cylindrical element 410 having an outer surface 411 with repeating hexagonal shapes 420. The shapes 420 are again elongated along an axis that is offset from the longitudinal and transverse axes of the cylindrical element 410. However, in this example, the shapes 420 are elongated to a lesser degree than those shown in FIGS. 4-6*a* and 4-6*b*, and the vertices 423 of each shape 420 have a smaller radius and are therefore more pointed. Water flowing around the element 410 in grooves 430 meets with at least one vertex 423 of the shapes 420, but may also be directed towards a flat side 424 or a portion of a flat side 424 of a shape 420. The water is split into different flow paths, and/or diverted by a flat side 424 of a shape 420.

FIGS. 4-6*d* show cylindrical element 510 having an outer surface 511 comprising hexagonal shapes 520 in a repeating pattern across the surface 511. Grooves 530 space the shapes 520 from one another. In this example, the grooves 530 are wider than the grooves 30 shown in FIGS. 1-3, i.e., the shapes 520 are spaced further apart than the shapes 20 in FIGS. 1-3. The shapes 520 are rotated in comparison to the alignment of the shapes 20 in the example illustrated in FIGS. 1-3, so that they are now point-side down (i.e. the shapes 520 have been rotated by 30° relative to the arrangement of shapes 20 illustrated in FIGS. 1-3 so that at least two vertices 523A, 523B, 523C, 523D are aligned along the longitudinal axis of the cylindrical element 510). In computer models of water flow over and around each of the various arrangements of shapes and grooves described here, the arrangement illustrated in FIGS. 4-6*d* was found to be particularly effective at reducing VIV and this is therefore the most preferred tessellation pattern applied on the surface 511 of the generally cylindrical element 510. Water flowing around the element 510 in grooves 530 meets with at least one vertex 523 of the shapes 520, but may also be directed towards a flat side 524A, 524B or a portion of a flat side 524A, 524B of a shape 520. The water is split into different flow paths, and/or diverted by a flat side 524A, 524B of a shape 520.

FIGS. 4-6*e* show cylindrical element 610 having an outer surface 611 comprising hexagonal shapes 620 that have been elongated along the longitudinal axis of the cylindrical element. The shapes 620 are arranged in a repeating pattern across the surface 611. Similarly, to FIGS. 4-6*d*, the shapes 620 are arranged so that two or more vertices 623A, 623B, 623C, 623D are aligned along the longitudinal axis of the cylindrical element 610. Water flows around grooves 630 and generally meets with a pointed corner/vertex 623 of at least one shape 620 as it travels around the cylindrical element 610. This acts to split the flow along different flow paths as before. The flow may also be directed towards a flat side 624A, 624B or a portion of a flat side 624A, 624B of a shape 620.

FIGS. 4-6*f* show cylindrical element 710 having an outer surface 711 comprising hexagonal shapes 720 in a repeating patter across the surface 711. Grooves 730 space the shapes 720 from each other. The shapes 720 are elongated along the longitudinal axis of the cylindrical element 710 and relatively densely packed in comparison to the shapes 520, 620 illustrated in FIGS. 4-6*d* and 4-6*e*. The elongation of the shapes 720 is greater than the shapes 620 of FIGS. 4-6*e* and results in two relatively acute vertices 723A, 723B, which are aligned along the longitudinal axis of the cylindrical element 710. Water flowing around the cylindrical element 710 in grooves 730 may meet with a vertex (e.g. upper vertex 723A) of a shape 720, or may flow towards a flat side 724 or a portion of a flat side 724 of a shape 720. Water flowing through the grooves 430 and contacting a vertex 723A of a shape 720 can be split into different flow paths. Water flowing along the grooves 730 and into a flat section 724 of a shape 720 may be diverted to flow in a different direction within the grooves 730.

FIG. 6(*g*) shows the example dimensions of the most preferred tessellation pattern applied on the surface 511 of the generally cylindrical element 510. In this example, the generally cylindrical element 510 has the following exemplar dimensions:—

- Outermost diameter 510D (of element 510)=1222 mm (and thus the Outermost radius 510OR=611 mm)
- GDepth 520D (Groove depth i.e. height of each shape 520)=60 mm
- Radius 520R (of the corner at the edge of each shape 520)=60 mm
- Thus GDepth 520D=Radius 520R
- Inner radius 5201R (of element 510 from centrepoint C to outer surface 511)=551 mm
- GCircumferential 530C (width of groove in between two adjacent shapes 520 in the direction around the circumference)=319.972 mm
- GDiagonal 530D (width of groove in between two adjacent shapes 520 in the diagonal direction between two adjacent and parallel flat sides 524*a* and 524*c* shown in FIG. 6(*g*)=350.054 mm The skilled person will understand that the various dimensions are liable to vary as per requirements of the particular application of use and will particularly vary dependent upon the inner radius 5201R of the cylindrical element 510 in question, but the various dimensions (e.g. the GDepth 520D, the Radius 520R, GCircumferential 530C and the GDiagonal 530D) are all preferably a relatively fixed ratio of the Inner Radius 5201R, as will be subsequently described in more detail. Simply put though, the greater the Inner Radius 5201R of the cylindrical element 510 in question, the greater the GDepth 520D but the relative proportions between the two are preferably substantially constant because the relative dimensions share come common feature ratios as will now be described. In all examples shown in FIGS. 4-6, some common feature ratios have been identified that lead to enhanced VIV suppression by the cylindrical element. These are:

- GDepth (i.e. the depth of the repeating shapes)=Outermost diameter (of the element multiplied by 0.05
- GDepth (i.e. the depth of the repeating shapes)=Radius (of the corner at the edge of each shape)
- GCircumferential (Width of groove in the circumferential direction)=Outermost radius of the element multiplied by 0.50 to 0.60 (eg. For the example shown in FIG. 6*g*, Outermost radius 510OR=611 mm multiplied by 0.525=approx. 320 mm)
- GDiagonal (Width of groove in the diagonal direction) =Outermost radius of the element multiplied by 0.55 to 0.60 (eg. For the example shown in FIG. 6*g*, Outermost radius 510OR=611 mm multiplied by 0.572=approx. 350 mm)
- Repeating shape angle=Equal sided and uniformly shaped hexagon, having the enclosed angle of each corner fixed at 120
- Preferred shape pattern comprises multiple rows of 3 fixed 120° enclosed angle hexagons equi-spaced per row around the circumference of the generally cylindrical element, with the adjacent row comprising 3 similarly shaped hexagons but offset by half a pitch out of phase (i.e. 60°) i.e. that pattern shown in FIG. 6(*g*).

There are three main fields of application for the generally cylindrical element 10, these being:

Distributed Buoyancy Modules (DBM) 62—as Shown in FIGS. 7(*a*) to 7(*d*)

DBM's 62 are typically used at selected points on the outside of a conduit 64 such as a riser 64 which extends in a body of water between a surface vessel (not shown) or platform and a subsea structure (not shown), where the function of the DBM 62 is to provide the conduit 64 with buoyancy at a required location (for example to enable the conduit 64 to be installed in a "lazy wave" or "lazy S" configuration). The generally cylindrical element 10 may be secured by any suitable means such as clamping or straps to the outside of the DBM 62 but more preferably, the generally cylindrical element 10 is fully integral with the DBM 62 such that the outer surface 11 of the element 10 is the (integral) outer surface 11 of the DBM 62 and in this scenario, the DBM 62 is not an integral cylinder but instead is provided in the form of two half shells 62U; 62L which, when brought together, form a cylinder or sleeve around the outer surface of riser 64. The majority or all of the DBM 62 is formed from a buoyancy material). The generally cylindrical element in the form of the DBM 62 is provided with suitable strap recesses 66 and lifting holes 68 to facilitate transportation, installation and securing of the generally cylindrical element in the form of the DBM 62.

Drill Riser Buoyancy (DRB) 70—as Shown in FIGS. 8(*a*) to 8(1)

DRB modules 70 are typically fitted along the whole length of a riser 71 (which typically have an arrangement of conductors 72 provided around their outer circumference along their length—five are shown in FIG. 8(*a*), particularly risers 71 that are used in deep water and ultra-deep water, to reduce the weight of the drilling riser 71 to a manageable level. The generally cylindrical element 10 is suitable for either a) application, fixing or otherwise securing to the outer surface of a DRB or more preferably b) as shown in FIG. 8(*a*) the outer surface of a DRB 70 can integrally comprise the shaped profile of the outer surface 11 as shown in FIGS. 1-3. DRB 70 is typically provided in either half shells 70L; 70R (as shown in FIGS. 8(*a*) to 8(*h*) or quarter shells (not shown) which when brought together surround/envelop the drill riser 71 and conductor arrangement 72. Such a DRB 70 (not shown) is preferably provided with stacking flats to permit individual shells 70L; 70R to be stacked one on top of the other. The two half shells 70L; 70R are preferably secured to one another around the riser 71 and conductor arrangement 72 by a suitable fixing means such as bolts (not shown) which pass through bolt holes 75 provided on either side of each half shell 70L; 70R at the upper and lower ends and which are secured in place with nuts (not shown) in order to pull/compress the two half shells 70L; 70R toward/against one another.

Cylindrical Shrouds Traditionally Used as VIV Strakes—First Embodiment Based Upon FIGS. 1-3

Certain underwater conduit such as cables, flow lines, pipes and pipelines can conventionally be provided with subsea VIV suppression strakes which typically comprise radially extending helically arranged fins which act to reduce the VIV. Instead of providing such conventional fins, the generally cylindrical element 10 having the outer surface 11 as shown in FIGS. 1-3 could be used instead, where the generally cylindrical element 10 would typically have a slit formed all the way along one side and where the generally cylindrical element 10 is therefore C-shaped and is opened out and is fitted around the circumference of the cable, flow line or pipeline to be protected, such that the C-shaped generally cylindrical element 10 entirely envelops the section of cables, flow line or pipeline around which it is placed, much like a sleeve.

Figure 9:
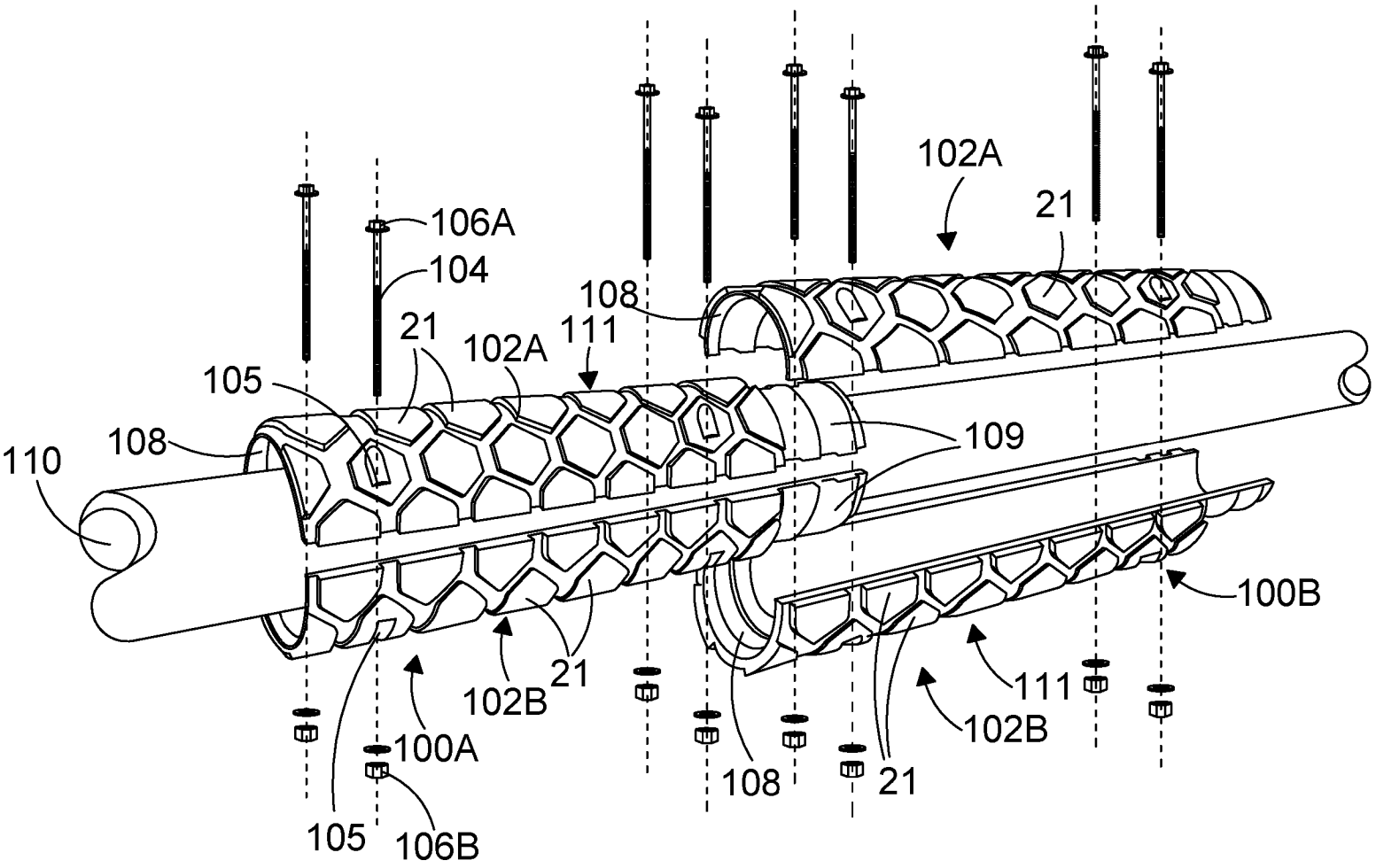
FIG. 9 is a perspective view of an embodiment of a generally cylindrical element adapted for submerging in a body of water and being profiled to reduce Vortex Induced Vibration (VIV) and/or drag, in accordance with the present invention, and particularly in the form of a two semi-circular part shells which when brought together around a subsea conduit such as a pipe can be bolted to one another (either at the time of first installation of such a conduit subsea or as retrofitting to an already subsea installed such conduit) to act as a cylindrical shroud to the subsea conduit.

Cylindrical Shrouds Traditionally Used as VIV Strakes—Second Embodiment as Shown in FIG. 9

In an alternative embodiment to the C-shaped generally cylindrical element 10 of FIGS. 1 to 3, the generally cylindrical element 100A as shown in FIG. 9 (having a hexagonal tessellation 21 as previously described provided on its outer surface 111) can be provided for fitment to a subsea conduit 110 such as a subsea cable, flexible jumper, flowline, riser, pipe or pipeline (either at the time of first installation of such a conduit subsea or as retrofitting to an already subsea installed such conduit 110).

The generally cylindrical element 100A of FIG. 9 comprises a two part or pair of semi-circular shells 102*a*, 102*b* which when brought together around such a conduit 110 (a pipe 110 is shown in FIG. 9) completely encircle by 360 degrees that section of conduit 110 around which the shells 102*a*, 102*b* are placed. The half shells 102*a*, 102*b* can be secured to one another with a suitable number (two such fastening means are shown in FIG. 9 at each end of the generally cylindrical element 100) of fastening means such as a threaded bolt 104 passing through boltholes 105 formed all the way through the sidewall of the half shells 102*a*, 102*b* and which can be secured in place by bolts and washers 106*b*. The generally cylindrical element 100A of FIG. 9 therefore acts as a shroud or sleeve to the conduit 110 and thereby provides the conduit 110 with subsea VIV suppression by virtue of the hexagonal tessellation 21 provided on its outer surface 111.

The two part or pair of semi-circular shells 102*a*, 102*b* are typically formed of a relatively lightweight, relatively strong and non-brittle material such as polyurethane (PU) or the like. Additionally, buoyant material such as polystyrene (not shown) or other suitable material may be added to the inner surface of the throughbore of the generally cylindrical element 100A (such that the buoyancy material is in the annulus between the inner throughbore of the generally cylindrical element 100A and the outer surface of the conduit 110) if the operator requires to add buoyancy to the conduit 110.

Additional generally cylindrical elements 1008 identical to the first generally cylindrical element 100A can be provided adjacent each end of the first generally cylindrical element 100A and so on until the whole length or a sufficient length of the conduit 110 is entirely enveloped by the generally cylindrical element 100A; 1008 of FIG. 9, much like a sleeve.

Each generally cylindrical element 100 is provided with a suitably shaped co-operating or mating surface provided on an outer end surface 109 at one end (which may be e.g. a lower in use end) and on an inner end surface 108 (which may be in use an uppermost end) at the other end. The mating surfaces may be suitably shaped co-operating surfaces such as radially acting tongue and groove arrangements or the like. During installation around the conduit 110, the second generally cylindrical element 1008 is placed around the conduit 110, with its upper end 108 having the inner mating surface lying in an overlapping manner with respect to the outer mating surface 109 of the lower most end of the first generally cylindrical element 100A, such that the respective radially acting tongue and groove arrangements mate with one another. This installation method is repeated down the length of the conduit 110 requiring VIV suppression by the generally cylindrical elements 100 and the respective radially acting tongue and groove arrangements prevent axial separation of adjacent generally cylindrical elements 100A; 1008.

Cylindrical Shrouds Traditionally Used as VIV Strakes—Third Embodiment as Shown in FIGS. 10(*a*) and 10(*b*)

FIGS. 10(*a*) and 10(*b*) show an alternative embodiment of a generally cylindrical element 120 to the generally cylindrical element 100 of FIG. 9, where the generally cylindrical element 120 as shown in FIG. 10 again comprises a hexagonal tessellation 21 as previously described provided on its outer surface 131.

However, the generally cylindrical element 120 of FIG. 10 differs from the generally cylindrical element 100 of FIG. 9 in that the generally cylindrical element 120 of FIG. 10 is installed on and secured around the conduit 110 by a different fastening means. As shown in FIG. 10, the outer surface of each of the two parts or pair of semi-circular shells 122*a*, 122*b* comprise a respective semi-circular recess or groove 123*a*, 123*b* at the same longitudinal position on the outside surface 141 of the respective half shell 122*a*, 122*b*. There is a respective semi-circular recess or groove 123*a*, 123*b* at each end of each of the two parts or pair of semi-circular shells 122*a*, 122*b*, such that when the two half shells 122, 122*b* are brought together around the subsea conduit 110, the two respective semi-circular recesses 123*a*, 123*b* combine to form a fully circular recess 123 of sufficient width to accept a circular strap 134 which is located around the 360-degree circumference of the two half shells 122, 122*b* within the recess 123 and wherein the strap 134 is tightened and secured within the recess 123 by a tie or lock 135 such that the two half shells 122, 122*b* are secured or locked to one another around the subsea conduit 110. Two recesses 123*a*, 123*b* are shown in FIG. 10(*a*) with one recess 123*a* being provided adjacent the upper most in use end 128 and the other recess 123*b* being provided adjacent the lower most in use end 129 of the generally cylindrical element 120 but further recesses 123 could additionally be provided spaced apart along the length of the generally cylindrical element 120 should they be required (particularly if the generally cylindrical element 120 is especially long).

In all other respects (including having an outer end surface 129 similar to the outer end surface 109 of FIG. 9 and including having an inner end surface 128 similar to the inner end surface 108 of FIG. 9), the generally cylindrical element 120 of FIG. 10 is similar to the generally cylindrical element 100 of FIG. 9 and can be installed for the same VIV suppression purpose around similar subsea conduits 110 such as a subsea cable, flexible jumper, flowline, riser, pipe or pipeline (either at the time of first installation of such a conduit 110 subsea or as retrofitting to an already subsea installed such conduit 110).

Figure 11B:
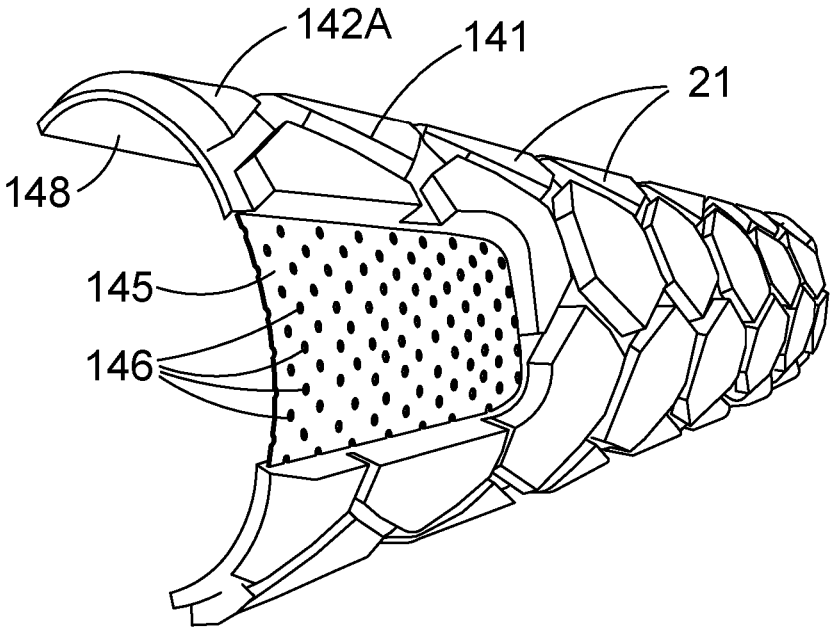
FIGS. 11(*a*) and 11(*b*) are perspective views of a yet further embodiment of a generally cylindrical element adapted for submerging in a body of water and being profiled to reduce Vortex Induced Vibration (VIV) and/or drag, in accordance with the present invention, and particularly in the form of a two semi-circular part shells which when brought together around a subsea conduit such as a pipe can be bolted or strapped to one another (either at the time of first installation of such a conduit subsea or as retrofitting to an already subsea installed such conduit) to act as a cylindrical shroud to the subsea conduit, where the two semi-circular shells each comprises a semi-circular cylindrical flexible substrate formed within the rest of the material (which is typically a moulded material)

Cylindrical Shrouds Traditionally Used as VIV Strakes—Fourth Embodiment as Shown in FIGS. 11(*a*) and 11(*b*)

FIGS. 11(*a*) and 11(*b*) show a further alternative embodiment of a generally cylindrical element 140 (albeit only one half thereof is shown in FIGS. 11(*a*) and 11(*b*)) to the generally cylindrical element 100 of FIG. 9 and 120 of FIGS. 10(*a*) and 10(*b*), where the generally cylindrical element 140 as shown in FIGS. 11(*a*) and 11(*b*) again comprises a hexagonal tessellation 21 as previously described provided on its outer surface 141.

The generally cylindrical element 140 of FIGS. 11(*a*) and 11(*b*) can be installed on and secured around the conduit 110 by any suitable fastening means such as:—

- a threaded bolt 104 passing through boltholes (not shown in FIGS. 11(*a*) and 11(*b*)) and secured in place by bolts and washers 106*b* in a similar manner to the fastening means shown in FIG. 9; or
- a circular strap 134 being is located around the 360-degree circumference of the generally cylindrical element 140 within a recess (not shown in FIGS. 11(*a*) and 11(*b*)) and wherein the strap 134 is tightened and secured within the recess by a tie or lock 135 such that the two half shells 142 are secured or locked to one another around the subsea conduit 110.

However, each of the two half shells 142 of the generally cylindrical element 140 of FIGS. 11(*a*) and 11(*b*) differs from those of the generally cylindrical element 100 of FIG. 9 and 120 of FIG. 10 in that the two half shells 142 each comprises a semi-circular cylindrical flexible substrate 145 formed within the rest of the material (which is typically moulded polyurethane) which forms the half shell 142. The semi-circular cylindrical flexible substrate 145 comprises a large plurality of holes 146 formed through its sidewall in order to reduce the weight thereof 142. The flexible substrate is preferably formed from a suitable flexible material and the half shell 142 is typically manufactured by pouring PU into a mould and around the substrate 145 such that the substrate 145 is enveloped by and encapsulated by the PU but provides a backbone to the PU once the PU has set. Accordingly, the flexible substrate 145 allows for greater flexibility of the generally cylindrical element 140, a reduced material requirement and improved comparative product durability compared to other embodiments.

This embodiment of generally cylindrical element 140 of FIGS. 11(*a*) and 11(*b*) has the advantage that a given thickness T2 of it will be stronger than the same thickness of the generally cylindrical element 100 of FIG. 9 and 120 of FIGS. 10(*a*) and 10(*b*). This embodiment of generally cylindrical element 140 of FIGS. 11(*a*) and 11(*b*) therefore has the advantage that it can be made thinner (see relatively thin sidewall T2 of the generally cylindrical element 140 as shown in FIG. 11(*a*) as compared with the relatively thick sidewall T1 of the generally cylindrical element 120 as shown in FIG. 10(*b*)) without sacrificing strength thereof. Accordingly, sidewall thickness T2 of generally cylindrical element 140 of FIGS. 11(*a*) and 11(*b*) is less than sidewall thickness T1 of generally cylindrical element 120 of FIGS. 10(*a*) and 10(*b*), and generally cylindrical element 140 of FIGS. 11(*a*) and 11(*b*) will likely be considerably lighter and thus easier to install on a conduit 110 than other embodiments.

An operator will typically be able to retrofit the generally cylindrical element 140 of FIGS. 11(*a*) and 11(*b*) onto the outer surface of an already installed subsea conduit 110 by:—

- pulling the subsea conduit 110 up out of the water through a moonpool of a sea going vessel/boat (not shown);
- installing the generally cylindrical element 140 onto the outer surface 141 of the subsea conduit 140; and
- lowering the subsea conduit 110 with applied generally cylindrical element 140 mounted onto its outer surface back down into the water through the moonpool.

This embodiment of generally cylindrical element 140 of FIGS. 11(*a*) and 11(*b*) has the yet further significant advantage that, because it is thinner in outer diameter than other embodiments, it will be easier/possible to retrofit onto an already installed subsea conduit 110 in situations where the subsea conduit 110 has to be pulled up through a moonpool which has an opening which is just wider than the outer diameter of the subsea conduit 110, compared with other wider embodiments e.g. 100, 120 which wouldn't be possible to pass back through the moonpool.

The generally cylindrical element 140 of FIGS. 11(*a*) and 11(*b*) therefore acts as a shroud or sleeve to the conduit 110 and thereby provides the conduit 110 with subsea VIV suppression by virtue of the hexagonal tessellation 21 provided on its outer surface 141.

Any one of the embodiments 100, 120, 140 of generally cylindrical element could be picked by an operator to replace the existing subsea conduit protection system/buoyancy system as appropriate.

Figure 12:
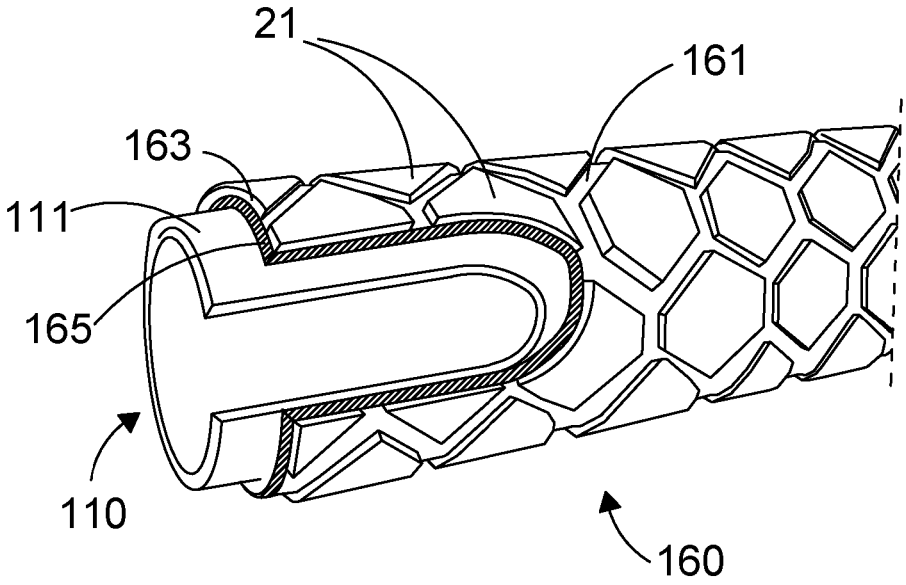
FIG. 12 is a perspective view of a yet further embodiment of a generally cylindrical element adapted for submerging in a body of water and being profiled to reduce Vortex Induced Vibration (VIV) and/or drag, in accordance with the present invention, and which is securely and integrally fitted to a subsea conduit at the time of manufacture of such a conduit by bonding it thereto.

Cylindrical Shrouds Traditionally Used as VIV Strakes—Fifth Embodiment as Shown in FIG. 12 and being Installed Directly onto Subsea Conduit In a yet further alternative embodiment to the C-shaped generally cylindrical element 10 of FIGS. 1 to 3, the generally cylindrical element 160 as shown in FIG. 12 (having a hexagonal tessellation 21 as previously described provided on its outer surface 161) can be securely and integrally fitted to a subsea conduit 110 such as a subsea cable, flexible jumper, flowline, riser, pipe or pipeline at the time of manufacture of such a conduit 110 by bonding it thereto.

The generally cylindrical element 160 of FIG. 12 therefore forms an integral outer sheath or covering to the subsea conduit 110 and completely encircles the conduit 110 by 360 degrees all along that longitudinal section of conduit 110 that it covers (which will typically be the entire length of conduit 110).

The inner surface 163 of the generally cylindrical element 160 of FIG. 12 may be directly bonded to the outer surface 111 of the conduit 110, or a cylindrical conduit or pipe insulation/coating 165 may optionally be sandwiched in a co-axial manner between the inner surface 163 of the generally cylindrical element 160 and the outer surface 111 of the conduit 110 and is preferably bonded both thereto. The pipe insulation/coating 165 may be formed of any suitable material. The pipe insulation/coating 165 may be formed from a buoyant material such as polystyrene (not shown) or other suitably buoyant material if the operator requires to add buoyancy to the conduit 110.

The generally cylindrical element 160 of FIG. 12 therefore acts as a shroud or sleeve to the conduit 110 and thereby provides the conduit 110 with subsea VIV suppression by virtue of the hexagonal tessellation 21 provided on its outer surface 161.

Other applications of embodiments in accordance with the present invention are possible, where VIV reduction and/or drag reduction particularly within subsea environments is required, without departing from the scope of the invention.

Modifications and improvements may be made to the embodiments hereinbefore described without departing from the scope of the invention.

What is claimed is:

1. A cylindrical element adapted for immersion in a body of water, the cylindrical element having an outer surface arranged, in use, to be in contact with the water, the outer surface comprising:

at least two rows of repeating shapes provided thereon, each row of repeating shapes being separated from each adjacent row by a groove arrangement and each shape within a row being separated from adjacent shapes by at least one groove;

wherein the groove arrangement for each row of repeating shapes comprises an upper groove and a lower groove, where each of the upper and lower grooves encircles the full 360 degree circumference of the generally cylindrical element such that each of said upper and lower grooves is continuous around the cylindrical element;

wherein the groove arrangement provides at least one separated path for a flow of water to follow around the circumference of the cylindrical element, such that water flowing within the groove arrangement meets at least one flow separation point;

wherein the outer surface of the cylindrical element reduces Vortex Induced Vibration (VIV) and/or drag acting upon the cylindrical element.

2. A cylindrical element as claimed in claim 1, wherein each of the repeating shapes within each row is identical.

3. A cylindrical element as claimed in claim 1, wherein each row provided on the outer surface comprises identical repeating shapes to the shapes of each other row, such that all of the shapes provided on the outer surface are identical.

4. A cylindrical element as claimed in claim 1, wherein the shapes comprise at least three sides.

5. A cylindrical element as claimed in claim 4, wherein the shapes comprise six sides to form a hexagon shape.

6. A cylindrical element as claimed in claim 1, wherein repeating shapes are arranged on the outer surface in a tessellation.

7. A cylindrical element as claimed in claim 5, wherein the outer surface of the cylindrical element comprises a hexagonal tessellation in which each three adjacent hexagon shapes meet at adjoining vertices and the rest of the hexagon shapes repeat that arrangement across the outer surface of the cylindrical element.

8. A cylindrical element as claimed in claim 1, wherein at least one vertex between two adjacent sides of each repeating shape comprises a radius.

9. A cylindrical element as claimed in claim 1, wherein each repeating shape projects from the outer surface of the cylindrical element due to the groove arrangements.

10. A cylindrical element as claimed in claim 1, wherein the cylindrical element is adapted to be placed around a substantially cylindrical structure which, in use, is located in the body of water.

11. A cylindrical element as claimed in claim 10, wherein the cylindrical element is formed of two or more sections that when brought together envelope the substantially cylindrical structure.

12. A cylindrical element as claimed in claim 1, wherein the cylindrical element is formed integrally with a substantially cylindrical structure which, in use, is located in the body of water.

13. A cylindrical element as claimed in claim 1, wherein the groove arrangement comprises angled side faces.

14. A cylindrical element as claimed in claim 13, wherein the angled side faces are angled between 40 to 80 degrees relative to the radius of the generally cylindrical element.

15. A cylindrical element as claimed in claim 1, wherein the groove arrangement comprises a semi-circular profile.

16. A cylindrical element as claimed in claim 15, wherein the width of the groove arrangement is within the range of 0.50 to 0.60 times the outermost radius of the cylindrical element.

17. A cylindrical element as claimed in claim 1, wherein the flow separation point comprises a vertex of a shape where two sides of the shape meet.

18. A cylindrical element as claimed in claim 1, wherein the flow separation point comprises a side of the shape.

19. A cylindrical element as claimed in claim 1, wherein when the water flowing within the groove arrangement meets a flow separation point, the direction of at least a portion of the water flow is changed by less than 90°.

20. A cylindrical element as claimed in claim 1, provided in multiple part circular shells which when brought together envelope the substantially cylindrical structure located in the body of water and which comprise buoyancy to aid floatation of the substantially cylindrical structure located in the body of water.

21. A cylindrical element as claimed in claim 20, further comprising stacking flats to permit individual shells to be stacked one on top of another.

22. A cylindrical element as claimed in claim 20, further comprising strap and/or bolt holes to assist coupling the shells to one another around a substantially cylindrical structure which, in use, is located in a body of water.

23. A cylindrical element as claimed in claim 20, further comprising strap and/or lifting holes to assist transportation of the cylindrical element or shells thereof.

24. A cylindrical element as claimed in claim 23, wherein a protective coating layer is provided between the inner surface/throughbore of the generally cylindrical element and the outer surface of the subsea conduit in a co-axial manner.

25. A cylindrical element as claimed in claim 24, wherein the protective coating layer is bonded to the respective surface on each of its outer and inner surfaces.

26. A cylindrical element as claimed in claim 1, wherein the inner surface/throughbore of the generally cylindrical element is bonded directly to the outer surface of the subsea conduit.

27. A cylindrical element as claimed in claim 1, wherein the said groove arrangements comprise a groove having a depth of profile=0.01 to 0.1 times the outer diameter (OD) of the generally cylindrical element.

28. A cylindrical element as claimed in claim 27, wherein the said groove arrangements comprise a groove having a depth of profile=approximately 0.05 times the outermost diameter (OD) of the generally cylindrical element.

29. A cylindrical element adapted for immersion in a body of water, the cylindrical element having an outer surface arranged, in use, to be in contact with the water, the outer surface comprising:

at least two rows of repeating shapes provided thereon;

each row of repeating shapes being separated from each adjacent row by a groove arrangement and each shape within a row being separated from adjacent shapes by at least one groove;

wherein the shapes comprise six sides to form a hexagon shape such that the outer surface of the cylindrical element reduces Vortex Induced Vibration (VIV) and/or drag acting upon the cylindrical element.

* * * * *